US009360807B2

(12) United States Patent
Kogure et al.

(10) Patent No.: US 9,360,807 B2
(45) Date of Patent: Jun. 7, 2016

(54) IMAGE FORMING APPARATUS

(71) Applicants: Seiichi Kogure, Kanagawa (JP); Naohiro Kumagai, Kanagawa (JP); Junpei Fujita, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(72) Inventors: Seiichi Kogure, Kanagawa (JP); Naohiro Kumagai, Kanagawa (JP); Junpei Fujita, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/802,374

(22) Filed: Jul. 17, 2015

(65) Prior Publication Data

US 2016/0041508 A1 Feb. 11, 2016

(30) Foreign Application Priority Data

Aug. 8, 2014 (JP) ..... 2014-162385
May 20, 2015 (JP) ..... 2015-102626

(51) Int. Cl.
*G03G 15/16* (2006.01)

(52) U.S. Cl.
CPC ..... *G03G 15/1665* (2013.01); *G03G 15/1605* (2013.01)

(58) Field of Classification Search
CPC combination set(s) only.
See application file for complete search history.

(56) References Cited

U.S. PATENT DOCUMENTS

2004/0170453 A1* 9/2004 Ito ..... G03G 15/167 399/315
2004/0218944 A1* 11/2004 Kawaguchi ..... G03G 15/165 399/90
2007/0280750 A1* 12/2007 Kurosu ..... G03G 15/1605 399/316
2009/0279927 A1 11/2009 Fujita
2010/0067952 A1 3/2010 Fujita et al.
2011/0013920 A1 1/2011 Wada
2011/0058859 A1 3/2011 Nakamatsu et al.
2011/0064487 A1 3/2011 Ichihashi et al.

(Continued)

FOREIGN PATENT DOCUMENTS

JP 11-045004 2/1999
JP 2008-003445 1/2008

(Continued)

OTHER PUBLICATIONS

U.S. Appl. No. 14/601,445, filed Jan. 21, 2015.

(Continued)

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus includes an image bearer on which a toner image is formed, an intermediate transfer belt onto which the toner image transferred from the image bearer, a secondary transfer member, a guide assembly, and a biasing device. The secondary transfer member meets the intermediate transfer belt to form a secondary transfer nip in which the toner image is transferred from the intermediate transfer belt onto a recording sheet. The guide assembly disposed upstream from the secondary transfer member in a transport direction of the recording sheet guides the recording sheet at a position lower than the secondary transfer nip such that a leading end of the recording sheet contacts the secondary transfer member before entering the secondary transfer nip. The biasing device biases the secondary transfer member to move the secondary transfer member in one of a direction of bias and a vertical direction.

15 Claims, 10 Drawing Sheets

(56) References Cited

U.S. PATENT DOCUMENTS

| | | | | |
|---|---|---|---|---|
| 2011/0081188 | A1* | 4/2011 | Kaseda | G03G 15/6564 400/611 |
| 2011/0158690 | A1 | 6/2011 | Mimbu et al. | |
| 2011/0211855 | A1 | 9/2011 | Kogure et al. | |
| 2011/0293312 | A1 | 12/2011 | Mimbu et al. | |
| 2012/0328321 | A1 | 12/2012 | Takeuchi et al. | |
| 2014/0072340 | A1 | 3/2014 | Kato et al. | |
| 2014/0199089 | A1* | 7/2014 | Ishikawa | G03G 15/1605 399/45 |
| 2014/0241744 | A1 | 8/2014 | Ichikawa et al. | |
| 2014/0334847 | A1 | 11/2014 | Takahashi et al. | |

FOREIGN PATENT DOCUMENTS

| | | |
|---|---|---|
| JP | 2008-096715 | 4/2008 |
| JP | 2010-054969 | 3/2010 |
| JP | 2011-133653 | 7/2011 |

OTHER PUBLICATIONS

U.S. Appl. No. 14/638,425, filed Mar. 4, 2015.
U.S. Appl. No. 14/742,730, filed Jun. 18, 2015.

* cited by examiner

IMAGE FORMING APPARATUS

CROSS-REFERENCE TO RELATED APPLICATIONS

This patent application is based on and claims priority pursuant to 35 U.S.C. §119 from Japanese Patent Application Nos. 2014-162385, filed on Aug. 8, 2014, and 2015-102626, filed on May 20, 2015, both in the Japan Patent Office, which are hereby incorporated herein by reference in their entirety.

BACKGROUND

1. Technical Field

Exemplary aspects of the present disclosure generally relate to an image forming apparatus, such as a copier, a facsimile machine, and a printer.

2. Description of the Related Art

There has been known a multicolor image forming apparatus in which color images of four different colors, i.e., cyan, magenta, yellow, and black are superimposed one atop the other to form a multicolor image. A tandem-type image forming apparatus is a mainstream multicolor image forming apparatus in recent years. In general, the tandem-type image forming apparatus includes four drum-shaped image bearers, one for each of the colors cyan, magenta, yellow, and black to form toner images. The image bearers are arranged in tandem along an image formation path.

In the image forming apparatus of this kind, an intermediate transfer belt is disposed contacting the image bearers from which the toner images are transferred onto the intermediate transfer belt one atop the other to form a composite toner image in a process known as primary transfer. The composite toner image on the intermediate transfer belt is transferred onto a transfer sheet or a recording medium supplied from a paper feed unit at a contact portion at which the transfer sheet contacts the intermediate transfer belt in a process known as secondary transfer.

Primary transfer devices are disposed inside the looped intermediate transfer belt opposite the respective image bearers via the intermediate transfer belt at the primary transfer portion. As the primary transfer devices, rollers (hereinafter referred to as primary transfer rollers) are commonly employed. A voltage is supplied to the primary transfer rollers, thereby transferring the toner image onto the intermediate transfer belt.

The intermediate transfer belt is looped around a pulley (i.e., a secondary-transfer opposed roller), and a secondary transfer device is disposed outside the loop formed by the intermediate transfer belt, opposite to the secondary-transfer opposed roller at a secondary transfer portion. As the secondary transfer device, a roller (hereinafter referred to as a secondary transfer roller) is commonly employed. An electric field is generated between the secondary transfer roller and the secondary-transfer opposed roller, thereby transferring the toner image from the intermediate transfer belt onto a recording medium.

In the image forming apparatus of this kind, it is important to move the surfaces of the image bearers and the intermediate transfer belt at a constant speed. Fluctuations in the surface moving speed of the image bearer causes stretching and shrinkage of an image. Even a slight fluctuation may cause irregular image density. Furthermore, even when the surface moving speed of the image bearer is constant, fluctuations in the traveling speed of the intermediate transfer belt cause a difference between the moving speed of the image bearer and the intermediate transfer belt, causing also stretching and shrinkage of an image.

An example of a cause of fluctuations in the traveling speed of the intermediate transfer belt includes the use of a thick sheet as a recording medium. When a relatively thick sheet enters a secondary transfer nip at which the secondary transfer roller and the secondary-transfer opposed roller meet and press against each other at the secondary transfer portion, load on the secondary-transfer opposed roller changes in order to introduce the leading edge of the thick sheet into the secondary transfer nip, which causes an instantaneous change in the speed. This causes fluctuations in the traveling speed of the intermediate transfer belt, which results in irregular image density of the image on the intermediate transfer belt during primary transfer.

SUMMARY

In view of the foregoing, in an aspect of this disclosure, there is provided an improved (or novel) image forming apparatus including an image bearer, an intermediate transfer belt, a secondary transfer member, a guide assembly, and a biasing device. A toner image is formed on the image bearer. The toner image is transferred from the image bearer onto the intermediate transfer belt. The secondary transfer member meets the intermediate transfer belt to form a secondary transfer nip in which the toner image is transferred from the intermediate transfer belt onto a recording sheet. The guide assembly is disposed upstream from the secondary transfer member in a transport direction of the recording sheet to guide the recording sheet at a position lower than the secondary transfer nip such that a leading end of the recording sheet contacts the secondary transfer member before entering the secondary transfer nip. The biasing device biases the secondary transfer member to move the secondary transfer member in one of a direction of bias and a vertical direction.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
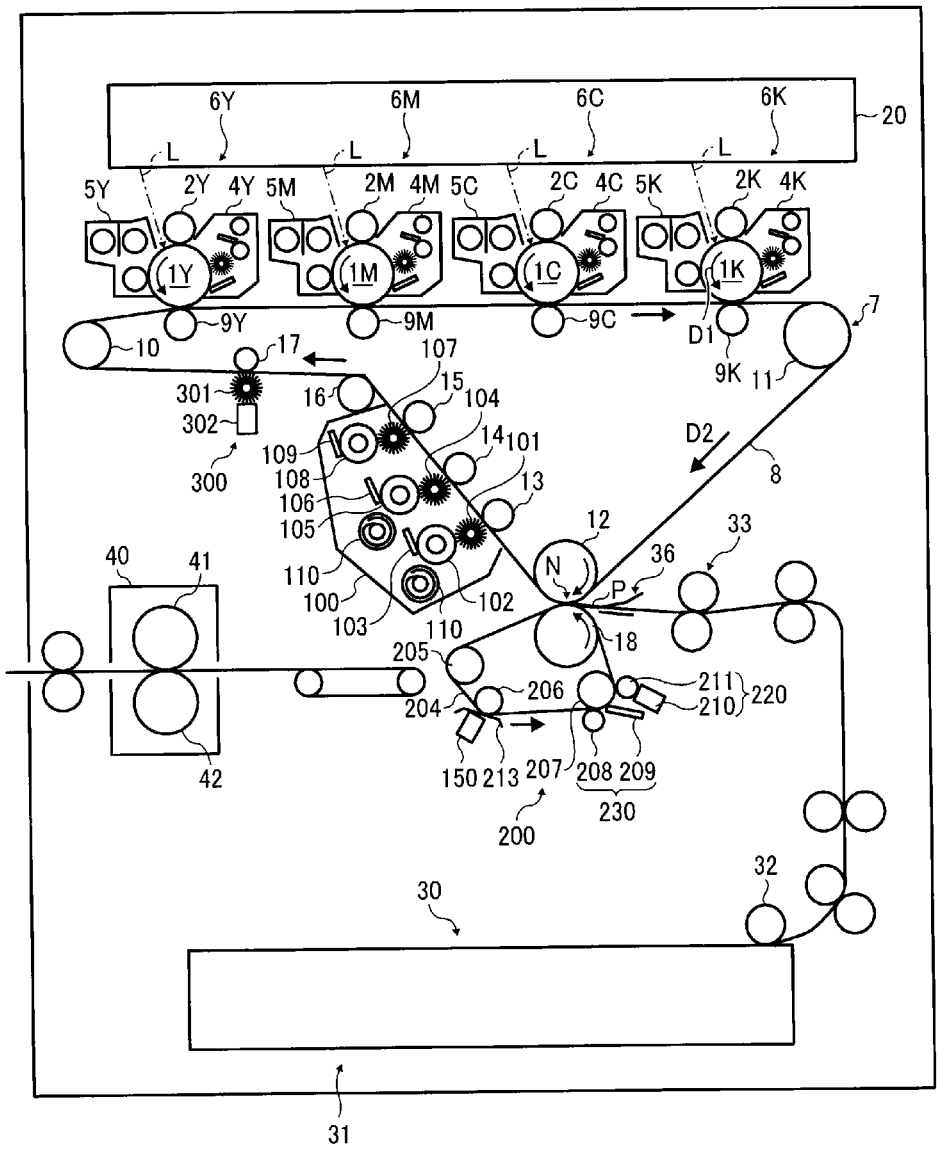
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

In order to facilitate an understanding of the novel features of the present invention, as a comparison, a description is provided of a comparative example of an image forming apparatus.

In order to prevent fluctuations in the traveling speed of an intermediate transfer belt that result in irregular image density when using a relatively thick recording medium, in one approach, the distance between the intermediate transfer belt and a secondary transfer device is adjusted in accordance with the thickness of the recording medium. When using a thick sheet, the distance between the intermediate transfer belt and the secondary transfer device is increased from the normal distance, thereby reducing impact when the thick sheet enters and exits the secondary transfer nip.

Increasing the distance between the intermediate transfer belt and the secondary transfer device in advance can reduce torque required to introduce the leading edge of the thick sheet into the secondary transfer nip between the intermediate transfer belt and the secondary transfer device, hence reducing the load on the intermediate transfer belt. With this configuration, fluctuations in the load and the speed of the intermediate transfer belt may be reduced, hence reducing irregular image density.

More specifically, in conjunction with the recording medium entering and exiting the secondary transfer nip between the intermediate transfer belt and the secondary transfer device, a moving device equipped with a contact member that contacts the intermediate transfer belt near the secondary transfer portion moves the contact member in directions that change the tension of the intermediate transfer belt. Accordingly, a transfer failure such as shock jitter may be prevented at the primary transfer portion when the recording medium enters the secondary transfer nip.

Here, the shock jitter refers to a phenomenon in which the impact generated by the recording medium striking the intermediate transfer belt is transmitted to the primary transfer portion and causes misalignment of toner images upon primary transfer of the toner images onto the intermediate transfer belt.

However, the amount by which the distance between the intermediate transfer belt and the secondary transfer device is increased is limited to a thickness of the recording medium because the secondary transfer device needs to apply a certain pressure to the recording medium to properly transfer the toner images onto the recording medium. This amount is not enough to prevent fluctuations in the speed, and the moving device to adjust the distance between the intermediate transfer belt and the secondary transfer device is required, hence increasing the cost.

Furthermore, when the transport speed at which the recording medium is transported is increased to increase productivity, it is difficult to complete adjustment of the distance between the intermediate transfer belt and the secondary transfer device at specific times such as between successive recording media sheets.

In view of the above, there is demand for an image forming apparatus capable of reducing shock jitter without increasing the cost while maintaining good productivity.

Referring now to the drawings, wherein like reference numerals designate identical or corresponding parts throughout the several views, exemplary embodiments of the present patent application are described.

With reference to FIG. 1, a description is provided of a tandem-type printer using an intermediate transfer method as an example of an image forming apparatus according to an illustrative embodiment of the present disclosure.

FIG. 1 is a schematic diagram illustrating a printer as an example of an image forming apparatus according to an illustrative embodiment of the present disclosure.

The image forming apparatus includes four process units 6Y, 6M, 6C, and 6K, one for each of the colors yellow, magenta, cyan, and black, respectively, to form toner images. The process units 6Y, 6M, 6C, and 6K include drum-shaped photoconductors 1Y, 1M, 1C, and 1K, respectively. Charging devices 2Y, 2M, 2C, and 2K, developing devices 5Y, 5M, 5C, and 5K, photoconductor cleaners 4Y, 4M, 4C, and 4K, and charge removers are respectively disposed around the photoconductors 1Y, 1M, 1C, and 1K.

The process units 6Y, 6M, 6C, and 6K all have the same configuration as all the others, differing only in the color of toner employed. It is to be noted that the suffixes Y, M, C, and K denote colors yellow, magenta, cyan, and black, respectively. To simplify the description, the suffixes Y, M, C, and K indicating colors are omitted herein, unless otherwise specified. An optical writing unit 20 is disposed above the process units 6Y, 6M, 6C, and 6K to irradiate the photoconductors 1Y, 1M, 1C, and 1K with laser light L and to write an electrostatic latent image on the surface of the photoconductors 1Y, 1M, 1C, and 1K. The photoconductors 1Y, 1M, 1C, and 1K rotate in a direction indicated by arrow D1.

A transfer unit 7 is disposed below the process units 6Y, 6M, 6C, and 6K. The transfer unit 7 includes an intermediate transfer belt 8. The intermediate transfer belt 8 is formed into an endless loop. The intermediate transfer unit 7 includes, inside the loop of the intermediate transfer belt 8, a plurality of tension rollers. The intermediate transfer unit 7 includes, outside the loop of the intermediate transfer belt 8, a secondary transfer device 200, a tension roller 16, a belt cleaning device 100, a first lubricant applicator 300, and so forth.

Furthermore, inside the loop of the intermediate transfer belt 8, four primary transfer rollers 9Y, 9M, 9C, and 9K, an idler roller 10, a drive roller 11, a secondary-transfer opposed roller 12, three cleaning opposed rollers 13, 14, and 15, and an application-brush opposed roller 17 are disposed. The intermediate transfer belt 8 is looped around these rollers and stretched taut. These rollers function as tension rollers. The cleaning opposed rollers 13, 14, and 15 do not necessarily apply a certain tension to the intermediate transfer belt 8 and may be driven to rotate along with rotation of the intermediate transfer belt 8. The drive roller 11 is driven to rotate clockwise by a driving device such as a motor, and the rotation of the drive roller 11 causes the intermediate transfer belt 8 to travel endlessly clockwise indicated by arrow D2 in FIG. 1.

The intermediate transfer belt 8 is interposed between the primary transfer rollers 9Y, 9M, 9C, and 9K disposed inside the looped intermediate transfer belt 8 and the photoconductors 1Y, 1M, 1C, and 1K. Accordingly, primary transfer nips are formed between the front surface (image bearing surface) of the intermediate transfer belt 8 and the photoconductors 1Y, 1M, 1C, and 1K contacting the intermediate transfer belt 8. A power source applies a primary transfer bias having a polarity opposite that of toner to the primary transfer rollers 9Y, 9M, 9C, and 9K.

The secondary transfer device 200 disposed outside the looped intermediate transfer belt 8 includes a secondary transfer roller 18, a separation roller 205, an optical-detector opposed roller 206, a cleaning opposed roller 207, and a secondary transfer belt 204. The secondary transfer belt 204 is looped around the secondary transfer roller 18, the separation roller 205, the optical-detector opposed roller 206, and the cleaning opposed roller 207.

Outside the loop formed by the secondary transfer belt 204, an optical detector unit 150, a secondary transfer cleaning device 230, and a second lubricant applicator 220 are disposed. The optical detector unit 150 is disposed opposite to the optical-detector opposed roller 206 via the secondary transfer belt 204. The secondary transfer cleaning device 230 includes a cleaning brush 208 and a cleaning blade 209 which contact the secondary transfer belt 204 looped around the cleaning opposed roller 207. The second lubricant applicator 220 includes a lubricant 210 and an application brush 211. The application brush 211 contacts the secondary transfer belt 204 entrained about the cleaning opposed roller 207, downstream from the cleaning blade 209 in the traveling direction of the secondary transfer belt 204.

A plurality of sheet guides 213 is disposed between the optical detector unit 150 and the secondary transfer belt 204 in a width direction of the secondary transfer belt 204. A shutter is disposed between the optical detector unit 150 and the secondary transfer belt 204 to prevent an optical element of the optical detector unit 150 from getting contaminated by toner when the optical detector unit 150 is not in operation. The shutter is turned on and off by a motor. According to the present illustrative embodiment, the shutter is a mechanical shutter. Alternatively, the shutter may be used in combination of an air shutter or the like.

The lubricant 210 to be applied to the surface of the secondary transfer belt 204 is formed of a fatty acid metal salt having a linear hydrocarbon chain. The fatty acid metal salt includes fatty acid including at least one of stearic acid, palmitic acid, myristic acid, and oleic acid, and metal including at least one of zinc, aluminum, calcium, magnesium, and lithium. In particular, zinc stearate is preferable because zinc stearate is mass-produced in an industrial scale and has been used successfully. In other words, the zinc stearate is most preferable because of its cost, stable quality, and reliability. The fatty acid metal salt for industrial use is not limited to a combination of a fatty acid and a metal salt. Alternatively, other suitable combinations of fatty acids and metal salts may be used. Furthermore, the fatty acid metal salts may contain metal oxide and free fatty acid.

The lubricant 210 is supplied to the surface of the secondary transfer belt 204 little by little in powder form by the application brush 211. More specifically, the application brush 211 scrapes the lubricant 210 in solid form. Another method in which the lubricant is applied to the secondary transfer belt 204 includes, but is not limited to, adding a lubricating agent to toner which is then adhered to the secondary transfer belt 204 at predetermined timing. However, in this case, the amount of supply depends on an image area of an output image. Thus, the lubricant cannot be applied to an entire belt surface. In view of the above, when supplying the lubricant 210 to the entire surface of the secondary transfer belt 204 by a simple structure, the application brush 211 that scrapes the lubricant 210 in solid form is suitable such as in the present illustrative embodiment.

In order to scrape the lubricant 210 by the application brush 211, the lubricant 210 is pressed against the application brush 211 by a pressing member such as an elastic member, for example, a spring.

The secondary transfer roller 18 serving as a secondary transfer member is driven by a drive motor as a drive source, causing the secondary transfer belt 204 to rotate. The intermediate transfer belt 8 contacts the secondary transfer belt 204 to form a secondary transfer nip N. The secondary transfer belt 204 may be rotated by receiving a driving force from the intermediate transfer belt 8. However, when the recording medium P passes through the secondary transfer nip N, the driving force is difficult to transmit from the intermediate transfer belt 8 to the secondary transfer belt 204. As a result, the speed of the secondary transfer belt 204 fluctuates easily. It is to be noted that the secondary transfer belt 204 may serve as the secondary transfer member.

The intermediate transfer belt 8 and the secondary transfer belt 204 are interposed between the secondary transfer opposed roller 12 disposed inside the looped intermediate transfer belt 8 and the secondary transfer roller 18. The place where the peripheral surface of the intermediate transfer belt 8 and the secondary transfer belt 204 contact is a so-called secondary transfer nip N. A secondary transfer bias having a polarity opposite that of toner is applied from a power source to the secondary-transfer opposed roller 12.

The intermediate transfer belt 8 is interposed between the cleaning opposed rollers 13, 14, and 15, and cleaning brush rollers 101, 104, and 107, respectively. Accordingly, cleaning nips are formed at places where the cleaning brush rollers 101, 104, and 107 contact the front surface of the intermediate transfer belt 8. The belt cleaning device 100 is replaceable together with the intermediate transfer belt 8. In a case in which the belt cleaning device 100 and the intermediate transfer belt 8 have different product life cycles, the belt cleaning device 100 may be detachably attachable relative to the main body of the image forming apparatus, independent of the intermediate transfer belt 8. A detailed description of the belt cleaning device 100 will be provided later.

The image forming apparatus of the present illustrative embodiment includes a paper feed unit 30 equipped with a paper cassette 31 and a feed roller 32. The paper cassette 31 stores a stack of recording media P. The feed roller 32 feeds the recording media P to a sheet passage. A pair of registration rollers 33 serving as a pair of feed rollers is disposed on the right side of the secondary transfer nip N in FIG. 1. The pair of registration rollers 33 receives the recording medium P from the paper feed unit 30 and feeds it to the secondary transfer nip N at predetermined timing.

A fixing device 40 is disposed on the left side of the secondary transfer nip N in FIG. 1 and includes a heating roller 41 and a pressing roller 42. The fixing device 40 receives the recording medium P bearing a toner image thereon from the secondary transfer nip N and fixes the toner image on the recording medium P with heat and pressure applied by the heating roller 41 and the pressing roller 42. In some embodiments, the image forming apparatus optionally includes toner supply devices that supply toners of yellow, magenta, cyan, and black to the respective developing devices 5Y, 5M, 5C, and 5K, if necessary.

In addition to normal or regular paper, for example, there is growing market demand for special paper having an embossed surface or paper used for thermal transfer such as iron print. Improper transfer of superimposed color toner images may occur more easily when transferring the toner images from the intermediate transfer belt 8 onto such special paper as compared with transferring the toner images onto normal paper.

In view of the above, the intermediate transfer belt 8 includes an elastic layer with relatively low hardness, thereby enabling the intermediate transfer belt 8 to deform in accordance with toner layers and recording media with a relatively rough surface at the secondary transfer nip N. The low-hardness elastic layer on the surface of the intermediate transfer belt 8 can deform in accordance with the surface condition of the intermediate transfer belt 8 which may be locally rough. With this configuration, the intermediate transfer belt 8 can tightly contact the toner layer without applying excessive transfer pressure and can uniformly transfer the toner layer even onto a recording medium with a rough surface, hence preventing toner voids (blank spots) and achieving higher imaging quality.

According to the present illustrative embodiment, the intermediate transfer belt 8 includes at least a base layer, an elastic layer on the base layer, and a surface layer (coat layer) provided on the elastic layer. The base layer is relatively stiff, but is still flexible. The elastic layer is relatively soft. The surface layer is formed of spherical particles.

First, a description is provided of the base layer. Examples of materials for the base layer include, but are not limited to, a filler (or an additive), in other words, a resin including an electrical resistance adjusting material, to adjust electrical resistance.

Examples of the resins constituting the base layer include, but are not limited to, fluorine-containing resins such as ethylene tetrafluoroethylene copolymers (ETFE) and polyvinylidene fluoride (PVDF) in terms of flame retardancy. In terms of mechanical strength (high elasticity) and heat resistance, specifically, polyimide resins or polyamide-imide resins are more preferred.

Examples of the electrical resistance adjusting materials include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include ketchen black, furnace black, acetylene black, thermal black, and gas black. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate.

It is to be noted that electrical resistance adjusting materials are not limited to above-mentioned materials.

The surface resistivity of the base layer is, preferably, in a range of from $1\times10^{8}$ Ω/sq to $1\times10^{14}$ Ω/sq, and the volume resistivity of the base layer is in a range of from $1\times10^{7}$ clan to $1\times10^{13}$ Ωcm. The carbon black is added to achieve a desired resistivity. More specifically, in terms of mechanical strength, the carbon black to be added is in such an amount that the film does not easily crack. Preferably, a coating liquid, in which a mixture of the resin component (for example, a polyimide resin precursor or a polyamide-imide resin precursor) and the electrical resistance adjusting material are adjusted properly, is used, and the electrical characteristics (i.e., the surface resistivity and the volume resistivity) and the mechanical strength are well balanced.

The content of the electrical resistance adjusting material in the coating liquid when using carbon black is in a range of from 10% to 25% by weight or preferably, from 15% to 20% by weight relative to the solid content. The content of the electrical resistance adjusting material in the coating liquid when using metal oxides is in a range of from 1% to 50% by weight or preferably, from 10% to 30% by weight relative to the solid content. If the content of the electrical resistance adjusting material is less than the above-described respective range, uniformity in the resistivities is difficult to achieve, resulting in fluctuations in the resistivities relative to a certain potential. If the content of the electrical resistance adjusting material is greater than the above-described respective range, the mechanical strength of the intermediate transfer belt drops, which is undesirable in actual use.

Next, a description is provided of the elastic layer disposed on the base layer.

A known acrylic rubber can be used for the elastic layer. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and workability.

Preferably, a Martens hardness of the elastic layer is in a range of from 0.2 $N/mm^2$ to 0.8 $N/mm^2$ when an indentation depth is 10 microns. The elastic layer made of acrylic rubber having the Martens hardness of less than 0.2 $N/mm^2$ is difficult to manufacture. However, if the Martens hardness exceeds 0.8 $N/mm^2$, the image quality relative to recording media with a rough surface drops. The Martens hardness can be measured using commercially available microhardness testing machines such as FISCHERSCOPE HM2000LT (registered trademark, manufactured by Fischer Instruments) with an indentation depth of 10 μm.

Preferably, the film thickness of the elastic layer is in a range of from 100 μm to 1000 μm. The image quality of the recording medium having a rough surface drops when using the belt with the elastic layer having a thickness of less than 100 μm. However, if the thickness exceeds 1000 μm, compression of the rubber becomes strong so that an end portion of the belt gets curled significantly.

It is necessary to add a conductive agent because the acrylic rubber itself has a high resistivity. Although carbons and ion conductive materials can be added to adjust the resistivity, ion conductive materials are preferable because the hardness of the rubber is important and even a small amount of ion conductive material can effectively control the resistivity so that the hardness of the rubber is not affected. More specifically, preferably, various types of perchlorates and ionic liquids in an amount from about 0.01 parts by weight to 3 parts by weight are added, based on 100 parts by weight of rubber. With the ion conductive material in an amount less than 0.01 parts by weight, the resistivity cannot be reduced effectively. However, with the ion conductive material in an amount more than 3 parts by weight, it is highly possible that the conductive material blooms or bleeds to the belt surface. The surface resistivity of the elastic layer is, preferably, in a range of from $1\times10^8$ Ω/sq to $1\times10^{13}$ Ω/sq, and the volume resistivity of the elastic layer is in a range of from $1\times10^7$ Ωcm to $1\times10^{12}$ Ωcm.

Next, a description is provided of the surface layer disposed on the elastic layer.

The surface layer is formed of spherical resin particulates. Examples of spherical resin particulate materials include, but are not limited to, spherical resin particulates having the following resin as a main component: acrylic resin, melamine resin, polyamide resin, polyester resin, silicone resin, and fluorocarbon resin. Alternatively, in some embodiments, surface processing with different material is applied to the surface of the particulate made of resin materials. It is to be noted that the resin particulate includes, but is not limited to rubber materials. In some embodiments, spherical particulates made of rubber materials and coated with hard resins may be employed.

The resin may be hollow or porous. Among such resins, the silicone resin particulates are most preferred because the silicone resin particulates provide good slidability, separability relative to toner, and wear and abrasion resistance.

Preferably, the spherical resin particulates are prepared through a polymerization process. The more spherical the particulate is, the more preferred. Preferably, the volume average particle diameter of the particulate is in a range of from 0.5 μm to 5 μm, and the particle dispersion is monodisperse with a sharp distribution. With a volume average particle diameter less than 0.5 μm, aggregation between particulates is significant, complicating application of the acrylic rubber onto the elastic surface evenly. By contrast, with a volume average particle diameter greater than 5 μm, the roughness of the surface of the belt after application of the particulates increases, resulting in toner cleaning failure.

Furthermore, since particulates often have insulation properties, if the particle diameter of the particulates is too large, the electrical potential remains due to the particulates, and accumulation of the electrical potential causes image defect upon continuous output of an image. Such monodisperse spherical resin particulates in powder form are directly applied to the resin layer and evened out, thereby evenly distributing the resin particulates with ease.

A time at which the spherical resin particles are applied to the surface of the elastic layer of the acrylic rubber is not limited. The spherical resin particulates are applied before or after vulcanization of the rubber.

The image forming apparatus of the present illustrative embodiment includes the first lubricant applicator 300 to apply a lubricating agent on the surface of the intermediate transfer belt 8 to protect the surface thereof. The first lubricant applicator 300 includes a brush roller 301 serving as an application device to contact and scrape a block (solid) lubricant 302 such as a block of zinc stearate while the brush roller 301 rotates. The lubricant in powder form thus obtained is applied to the surface of the intermediate transfer belt 8. Although the image forming apparatus of the present illustrative embodiment includes the first lubricant applicator 300, the first lubricant applicator 300 does not necessarily need to apply the lubricant 302 depending on the choice of toner, choice of the material of the intermediate transfer belt 8, and the friction coefficient of the surface of the intermediate transfer belt 8.

Figure 2:
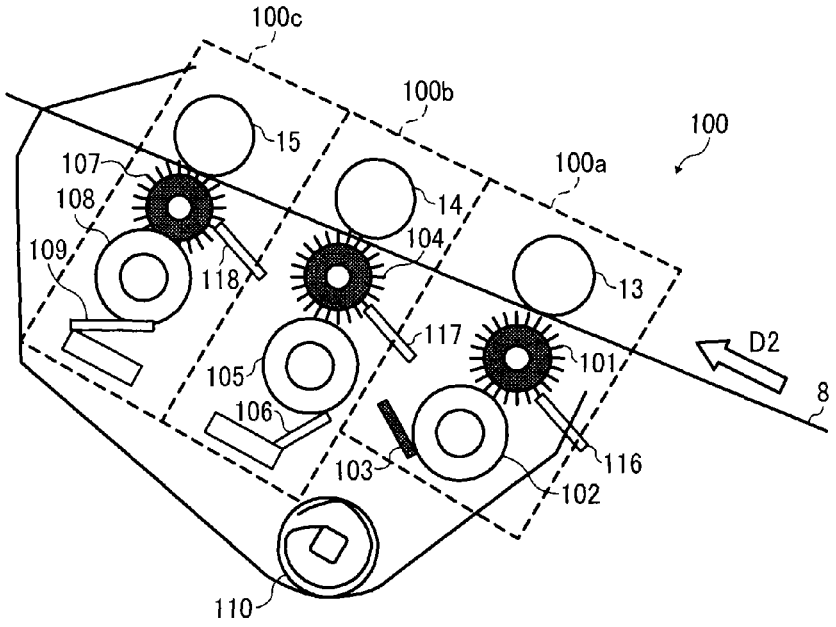
FIG. 2 is a schematic diagram illustrating a belt cleaning device employed in the image forming apparatus illustrated in FIG. 1.

FIG. 2 is a schematic diagram illustrating the belt cleaning device 100 employed in the image forming apparatus illustrated in FIG. 1.

In FIG. 2, the belt cleaning device 100 includes three cleaning stations. More specifically, the belt cleaning device 100 includes a first cleaning station 100*a*, a second cleaning station 100*b*, and a third cleaning station 100*c*. The first cleaning station 100*a* removes roughly residual toner remaining on the intermediate transfer belt 8. The second cleaning station 100*b* removes, from the intermediate transfer belt 8, toner charged with a polarity (positive polarity) opposite that of normally-charged toner (negative polarity). The third cleaning station 100*c* removes the normally-charged toner on the intermediate transfer belt 8.

The first cleaning station 100*a* includes the first cleaning brush roller 101, a first toner collecting roller 102, a first scraping blade 103, and a first flicker bar 116. The second cleaning station 100*b* includes the second cleaning brush roller 104, a second toner collecting roller 105, a second scraping blade 106, and a second flicker bar 117. The third cleaning station 100*c* includes the third cleaning brush roller 107, a third toner collecting roller 108, a third scraping blade 109, and a third flicker bar 118.

The first toner collecting roller 102, the second toner collecting roller 105, and the third toner collecting roller 108 collect toner adhering to the first cleaning brush roller 101, the second cleaning brush roller 104, and the third cleaning brush roller 107, respectively. The first scraping blade 103, the second scraping blade 106, and the third scraping blade 109 contact the first toner collecting roller 102, the second toner collecting roller 105, and the third toner collecting roller 108, respectively, to remove the toner from the roller surface. The first flicker bar 116, the second flicker bar 117, and the third flicker bar 118 flick the toner from the first cleaning brush roller 101, the second cleaning brush roller 104, and the third cleaning brush roller 107, respectively.

The belt cleaning device 100 further includes a conveyor screw 110 that transports the toner removed by the first cleaning station 100*a*, the second cleaning station 100*b*, and the third cleaning station 100*c* to a waste toner tank disposed in the main body of the image forming apparatus.

When receiving image information from a personal computer or the like, the drive roller 11 is rotationally driven so as to endlessly move the intermediate transfer belt 8. The rollers other than the drive roller 11 around which the intermediate transfer belt 8 is looped are idler rollers and rotated due to the rotation of the intermediate transfer belt 8. At the same time, the photoconductors 1Y, 1M, 1C, and 1K of the process units 6Y, 6M, 6C, and 6K are driven to rotate. While the charging devices 2Y, 2M, 2C, and 2K uniformly charge the surfaces of the photoconductors 1Y, 1M, 1C, and 1K, respectively, the charged surfaces of the photoconductors 1Y, 1M, 1C, and 1K are irradiated with laser light L to form electrostatic latent images on each of the photoconductors 1Y, 1M, 1C, and 1K.

The developing devices 5Y, 5M, 5C, and 5K develop the electrostatic latent images on the surfaces of the photoconductors 1Y, 1M, 1C, and 1K with toner of respective colors into a yellow toner image, a magenta toner image, a cyan toner image, and a black toner image, respectively. The yellow toner image, the magenta toner image, the cyan toner image, and the black toner image are transferred onto the outer peripheral surface or the image bearing surface of the intermediate transfer belt 8 one atop the other in the respective primary transfer nips. Accordingly, a composite toner image, in which the yellow toner image, the magenta toner image, the cyan toner image, and the black toner image are superimposed one atop the other, is formed on the outer peripheral surface of the intermediate transfer belt 8.

At the same time, in the paper feed unit 30, the feed roller 32 feeds a sheet of recording medium P from the paper feed cassette 31 toward the pair of registration rollers 33. Rotation of the pair of registration rollers 33 stops when the leading end of the recording medium P is interposed therebetween. Subsequently, the pair of registration rollers 33 is rotated again to feed the recording medium P to the secondary transfer nip N in appropriate timing such that the recording medium P is aligned with the composite, multicolor toner image formed on the intermediate transfer belt 8 in the secondary transfer nip N. Accordingly, the composite multicolor toner image is formed on the recording medium P. The recording medium P, on which the multicolor toner image is formed, is then delivered from the secondary transfer nip N to the fixing device 40 so that the multicolor toner image is fixed on the recording medium P.

After the yellow, magenta, cyan, and black toner images are primarily transferred from the photoconductors 1Y, 1M, 1C, and 1K onto the intermediate transfer belt 8, the photoconductor cleaners 4Y, 4M, 4C, and 4K remove the residual toner remaining on the respective photoconductors 1Y, 1M, 1C, and 1K. Subsequently, the charge removers such as charge erasing lamps eliminate electric charges remaining on the photoconductors 1Y, 1M, 1C, and 1K. Then, the photoconductors 1Y, 1M, 1C, and 1K are again charged uniformly by the charging devices 2Y, 2M, 2C, and 2K, respectively, in preparation for the subsequent imaging cycle.

After the composite toner image is secondarily transferred from the intermediate transfer belt 8 onto the recording medium P, the belt cleaning device 100 removes residual toner remaining on the intermediate transfer belt 8.

Suitable toner for use in the above-described image forming apparatus according to an illustrative embodiment of the present disclosure is described in detail below.

The toner has a volume average particle diameter (Dv) preferably in a range of from 3 μm to 6 μm to reproduce fine-dot toner images with a size of 600 dpi (dot per inch) or smaller. A ratio (Dv/Dn) of the volume average particle diameter (Dv) to the number average particle diameter (Dn) of the toner is preferably in a range of from 1.00 to 1.40. As the ratio (Dv/Dn) is close to 1.00, the toner has a narrower particle diameter distribution. Such toner having a small particle diameter and a narrow particle diameter distribution has a uniform charge distribution, which can produce high quality images without background fogging. In particular, such toner exhibits a high transfer rate in an electrostatic transfer method.

Figure 3:
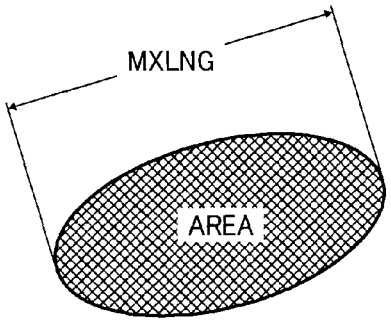
FIG. 3 is a schematic diagram illustrating a shape of a toner particle for explaining the shape factor SF-1.

The toner preferably has a first shape factor SF-1 in a range of from 100 to 180, and a second shape factor SF-2 in a range of from 100 to 180. FIG. 3 is a schematic diagram illustrating a shape of toner for explaining the first shape factor SF-1. The first shape factor SF-1 represents a degree of roundness of a toner particle and is represented by formula 1:

$$SF\text{-}1=\{(MXLNG)^2/AREA\}\times(100\pi)/4,$$

where MXLNG represents a maximum diameter of a projected image of a toner particle on a two-dimensional plane, and AREA represents an area of the projected image.

When the first shape factor SF-1 is 100, the toner particle has a true spherical shape. The greater is the first shape factor SF-1, the more irregular is the toner shape.

Figure 4:
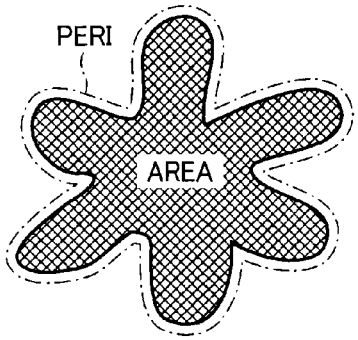
FIG. 4 is a schematic diagram illustrating a shape of a toner particle for explaining the shape factor SF-2.

FIG. 4 is a schematic diagram illustrating a shape of toner for explaining the second shape factor SF-2. The second shape factor SF-2 represents the degree of roughness of a toner particle, and is represented by formula 2:

$$SF\text{-}2=\{(PERI)^2/AREA\}\times100/(4\pi),$$

where PERI represents a peripheral length of a projected image of a toner particle on a two-dimensional plane and AREA represents the area of the projected image.

When the second shape factor SF-2 is 100, the toner particle has a completely smooth surface without roughness. The greater is the second shape factor SF-2, the rougher is the toner surface.

The shape factors are determined by obtaining a photographic image of toner particles with a scanning electron microscope (S-800 manufactured by Hitachi, Ltd.) and analyzing the photographic image with an image analyzer (LUZEX 3 manufactured by Nireco Corporation). When the shape of the toner particle becomes close to a sphere, toner particles contact each other as well as the photoconductors 1 in a point contact manner. Consequently, the absorption force between the toner particles weakens, resulting in high fluidity of the toner particles. Moreover, the absorption force between the toner particles and the photoconductors 1 weakens, resulting in an increase in the transfer rate. When any one of the shape factors SF-1 and SF-2 exceeds 180, the transfer rate may deteriorate, which is not desirable.

The toner has a substantially spherical shape that can be defined by the following shape factors.

Figure 5A:
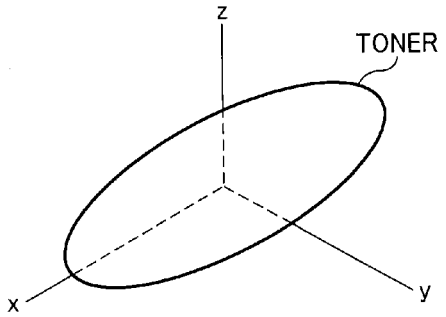
FIGS. 5A, 5B, and 5C are schematic diagrams illustrating a toner particle.
Figure 5B:
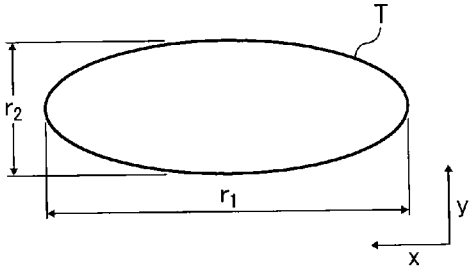
Figure 5C:
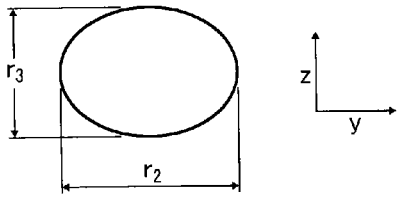

FIGS. 5A through 5C are schematic diagrams illustrating a shape of a toner particle. The toner has a substantially spherical shape with a long axis r1, a short axis r2, and a thickness r3, and the relation of r1≥r2≥r3 is satisfied. Referring to FIG. 5B, the ratio (r2/r1) of the short axis r2 to the long axis r1 is preferably in a range of from 0.5 to 1.0. Referring to FIG. 5C, the ratio (r3/r2) of the thickness r3 to the short axis r2 is preferably in a range of from 0.7 to 1.0. When the ratio (r2/r1) of the short axis r2 to the long axis r1 is less than 0.5, the shape of the toner is not spherical, and both dot-reproducibility and transfer efficiency are decreased. When the ratio (r3/r2) of the thickness r3 to the short axis r2 is less than 0.7, the shape of the toner is nearly flat. Consequently, such toner particles cannot provide high transfer efficiency, which is generally obtained with spherical toner particles. When the ratio (r3/r2) of the thickness r3 to the short axis r2 is 1.0, the toner particles can rotate on the long axis, and therefore the toner has excellent fluidity.

It is to be noted that the long axis r1, the short axis r2, and the thickness r3 were measured by a method in which a toner particle was observed with a scanning electron microscope (SEM) at different viewing angles.

Upon application of power or at every predetermined printing operation, image density control is performed to optimize the image density for each color.

Figure 6:
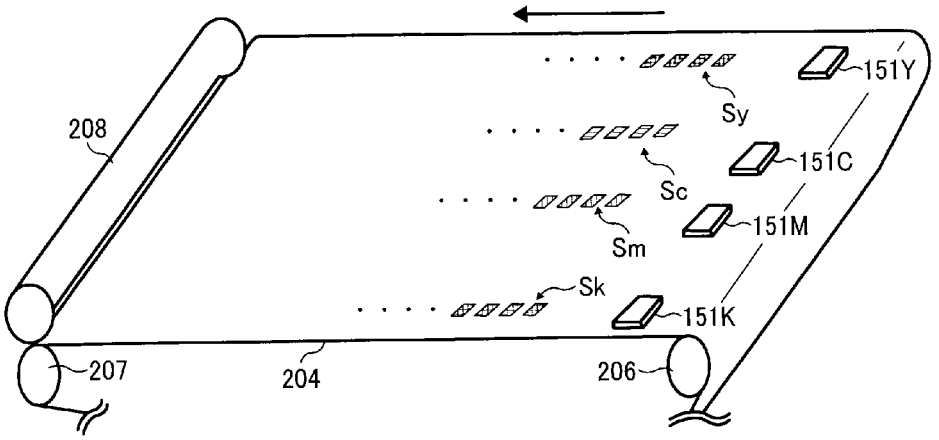
FIG. 6 is a schematic diagram illustrating a secondary transfer belt and toner test patterns.

In the image density control, as illustrated in FIG. 6, initially, gradation patterns Sk, Sm, Sc and Sy as test toner patterns are automatically formed on the secondary transfer belt 204 at positions facing each of optical detectors 151K, 151M, 151C, and 151Y, respectively. Each gradation pattern comprises ten toner patches, each of which has an area of 2 cm×2 cm and has a different image density form each other. When forming the gradation patterns Sk, Sm, Sc, and Sy, the surface potentials of the photoconductors 1Y, 1M, 1C, and 1K are gradually increased, in contrast to the normal printing process in which the surface potentials are kept constant. Subsequently, a plurality of electrostatic latent patches is formed on the photoconductors 1Y, 1M, 1C, and 1K by laser light scanning and then developed into toner patches by the developing devices 5Y, 5M, 5C, and 5K, respectively.

When developing the electrostatic latent patches into the toner patches, the developing bias applied to the developing rollers are gradually increased. As a result, gradation patterns of yellow, magenta, cyan, and black are formed on the respective photoconductors 1Y, 1M, 1C, and 1K. The gradation patterns are then secondarily transferred onto the secondary transfer belt 204 at a predetermined interval in the main scanning direction which coincides with a belt width direction.

The weight of toner in the toner patch having the lowest image density is approximately 0.1 mg/cm$^2$, and the weight of toner in the toner patch having the highest image density is approximately 0.55 mg/cm$^2$. In addition, the polarity of the color toners is the same, and each of the toners has a normal Q/d (i.e., (charge quantity)/(diameter)) distribution.

Figure 7:
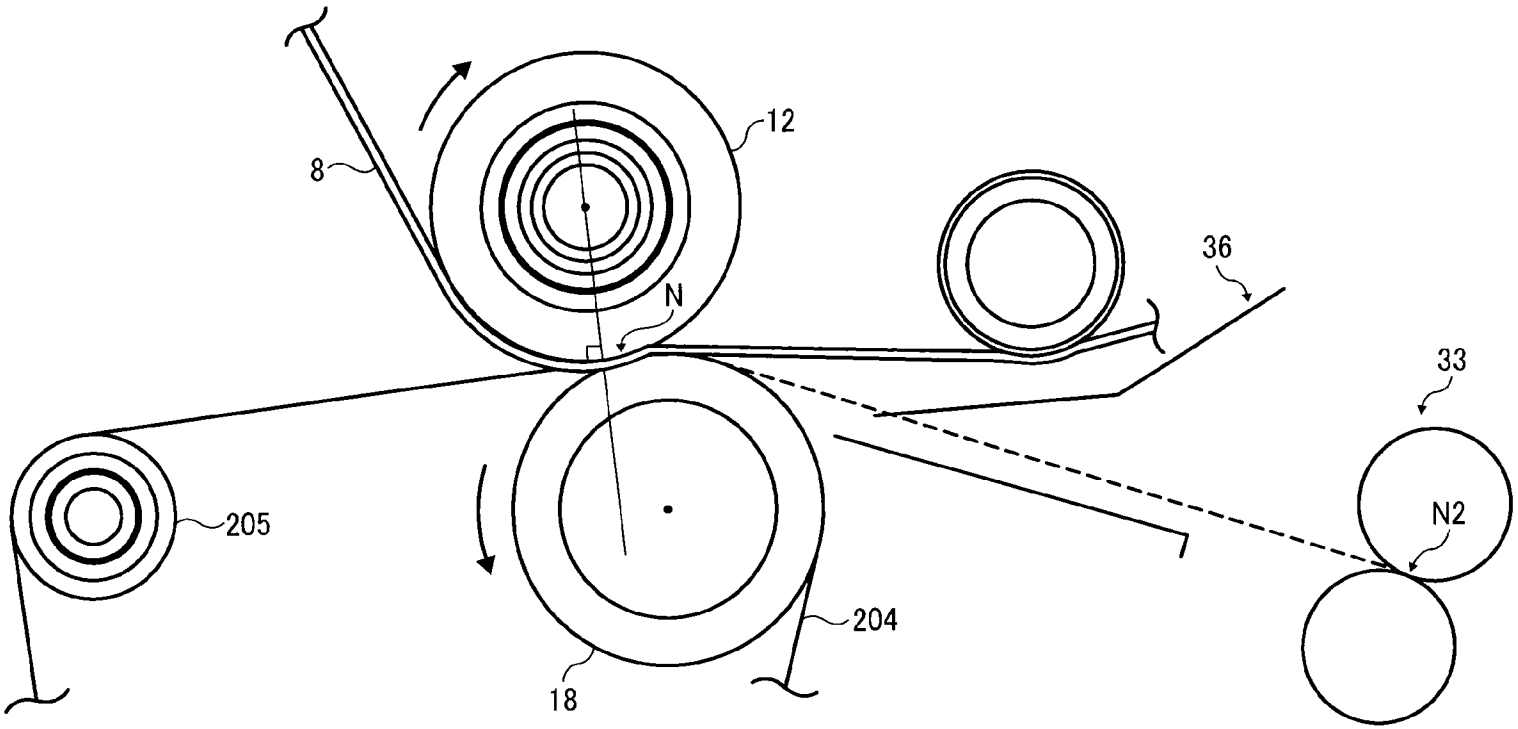
FIG. 7 is a schematic diagram illustrating a secondary transfer roller, secondary-transfer opposed roller, a pair of registration rollers, and a pair of entry guides.

With reference to FIG. 7, a description is provided of characteristics of the present disclosure.

In known image forming apparatuses, when the leading edge of the recording medium P enters the secondary transfer nip N, the recording medium P strikes the intermediate transfer belt, causing the shock jitter. To address this difficulty, when the leading edge of the recording medium P enters the secondary transfer nip N, the secondary transfer roller is spaced apart from the intermediate transfer belt by a cam. After the recording medium exits the secondary transfer nip N, the secondary transfer roller is moved toward the intermediate transfer belt by the cam gradually, thereby reducing shock jitter when the recording medium exits the secondary transfer nip N. This configuration, however, complicates the structure of the cam, the driving system, and the control system, resulting in an increase in the cost.

FIG. 7 is a schematic diagram illustrating the secondary transfer roller 18, the secondary-transfer opposed roller 12, the pair of registration rollers 33, and a pair of entry guides 36 according to an illustrative embodiment of the present disclosure.

According to the present illustrative embodiment, as illustrated in FIG. 7, the secondary transfer roller 18 is situated offset to the upstream side in the transport direction of the recording medium relative to the secondary-transfer opposed roller 12. The pair of entry guides 36 as a guide member guides the recording medium P at a position lower than the secondary transfer nip N in the vertical direction such that the leading end of the recording medium P contacts the secondary transfer roller 18 before the leading end of the recording medium P enters the secondary transfer nip N.

More specifically, as illustrated in FIG. 7, the portion of the pair of entry guides 36 that holds the recording medium P projects beyond a dotted line segment from the start of the secondary transfer nip N to a nip N2 of the pair of registration rollers 33 toward the secondary transfer roller side. In other words, the pair of entry guides 36 includes a guide surface that contacts the recording medium P. An intersection of an extension line of the guide surface and the secondary transfer roller 18 is lower than the secondary transfer nip N in the vertical direction. The secondary transfer roller 18 is biased upward by a biasing member such as a coil spring 71 (illustrated in FIG. 8A), and is movable in the direction of bias or a vertically down direction.

With this configuration, when the leading end of the recording medium P enters the secondary transfer nip N, the secondary transfer roller 18 and the secondary transfer belt 204 receive a downward force from the recording medium P so that the secondary transfer roller 18 and the secondary transfer belt 204 are pushed down. Accordingly, the impact is absorbed by the secondary transfer roller 18, thereby reducing the impact to be transmitted from the recording medium P to the intermediate transfer belt 8. With this configuration, the shock jitter is reduced, if not prevented entirely, when the recording medium P exits the secondary transfer nip N.

Furthermore, the pair of registration rollers 33 that feeds the recording medium P is disposed upstream from the pair of entry guides 36 in the transport direction of the recording medium P. The nip N2 formed by the pair of registration rollers 33 is situated lower than the pair of entry guides 36 in the vertical direction. In a configuration in which the pair of entry guides 36 guides the recording medium P at a position lower than the secondary transfer nip N in the vertical direction, the recording medium P can be reliably sent from the nip N2 formed by the pair of registration rollers 33 to the secondary transfer nip N.

In the present illustrative embodiment, the pair of entry guides 36 is a pair of guides that contacts the front and back surfaces of the recording medium P. The front and back surfaces of the recording medium P is interposed between the pair of entry guides 36, thereby reliably controlling the movement of the recording medium P. With this configuration, the secondary transfer roller 18 and the secondary transfer belt 204 can be reliably moved in the direction of bias or the downward direction.

Figure 8A:
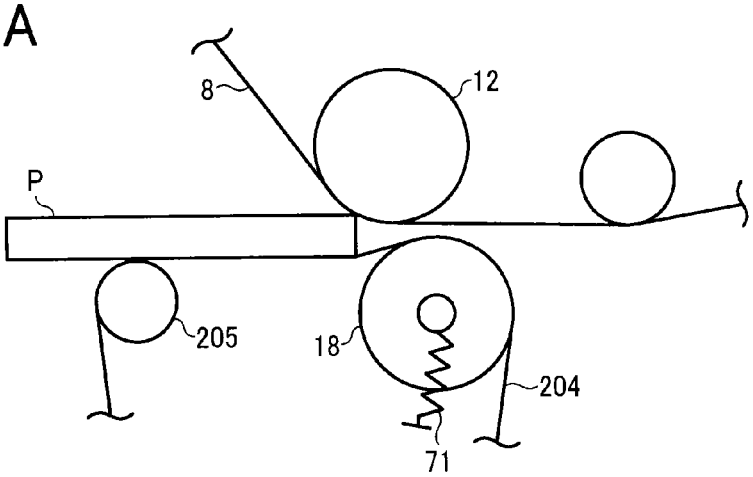
FIGS. 8A, 8B, and 8C are schematic diagrams illustrating a recording medium that passes through a secondary transfer nip.
Figure 8B:
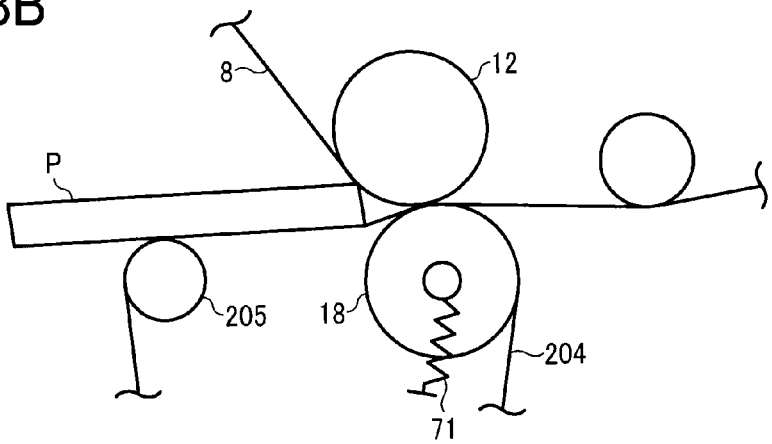
Figure 8C:
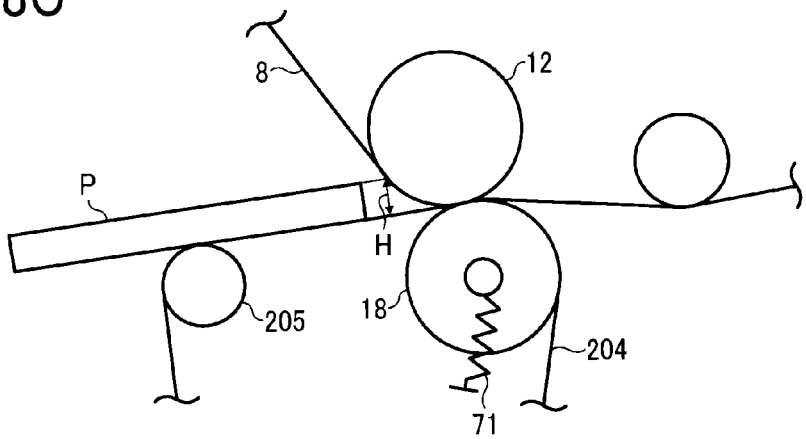

With reference to FIGS. 8A through 8C, a description is provided of the recording medium P passing through the secondary transfer nip N. FIGS. 8A through 8C are schematic diagrams illustrating the recording medium P that passes through the secondary transfer nip N.

As described above, when the leading end of the recording medium P enters the secondary transfer nip N, the secondary transfer roller 18 and the secondary transfer belt 204 receive a downward force from the recording medium P so that the secondary transfer roller 18 and the secondary transfer belt 204 are pushed down. After the trailing edge of the recording medium P exits the secondary transfer nip N, the recording medium P is carried on the secondary transfer belt 204 and gets transported further. As illustrated in FIG. 8A, when the trailing edge of the recording medium P exits the secondary transfer nip N, the bias force of the coil spring 71 causes the secondary transfer roller 18 to lift the secondary transfer belt 204. At this time, the trailing edge of the recording medium P that has exited the secondary transfer nip N contacts a wound portion of the intermediate transfer belt 8 wound around the secondary-transfer opposed roller 12. Consequently, the movement of the secondary transfer roller 18 is restricted, and the secondary transfer roller 18 moves slightly to the intermediate transfer belt 8.

Subsequently, as illustrated in FIG. 8B, when the recording medium P is transported further by the secondary transfer belt 204, the bias force of the coil spring 71 against the secondary transfer roller 18 causes the trailing edge of the recording medium P to move along the wound portion of the intermediate transfer belt 8 wound around the secondary-transfer opposed roller 12. That is, the recording medium P is transported in such a manner that the trailing edge of the recording medium P is lifted up gradually along the curve of the secondary-transfer opposed roller 12. Accordingly, as the recording medium P is transported, the secondary transfer roller 18 approaches gradually the secondary-transfer opposed roller 12.

Subsequently, as illustrated in FIG. 8C, when the recording medium P is transported to a position at which the distance between the surface of the secondary transfer belt 204 and the intermediate transfer belt 8 is the same as a thickness H of the recording medium P, the secondary transfer belt 204 contacts the intermediate transfer belt 8 at a predetermined pressure.

According to the present illustrative embodiment, the secondary transfer roller 18 is situated offset to the upstream side in the transport direction of the recording medium P relative to the secondary-transfer opposed roller 12, thereby moving gradually the secondary transfer roller 18 to the secondary-transfer opposed roller 12. This configuration prevents the secondary transfer roller 18 from striking the intermediate transfer belt 8 together with the secondary transfer belt 204 when the recording medium P exits the secondary transfer nip N. Accordingly, the shock jitter is reduced, if not prevented entirely, when the recording medium P exits the secondary transfer nip N.

According to the present illustrative embodiment, the vertical distance or the distance in the up-and-down direction between the secondary transfer nip N and the pair of registration rollers 33 is approximately 15 mm. However, according to an experiment performed by the present inventors, as long as the distance is equal to or greater than 5 mm, the shock jitter can be reduced, if not prevented entirely.

Furthermore, in order to press down the secondary transfer roller 18 more easily, the fulcrum of the secondary transfer device 200 that holds the secondary transfer roller 18 can be situated at the upstream side in the transport direction of the recording medium P.

Still further, the following configurations are also effective to press down easily the secondary transfer roller 18. For example, the direction of stretch of the coil spring 71 to form the secondary transfer nip N has an acute angle relative to a line segment from the fulcrum to the secondary transfer nip N, or the spring constant is reduced.

Figure 9:
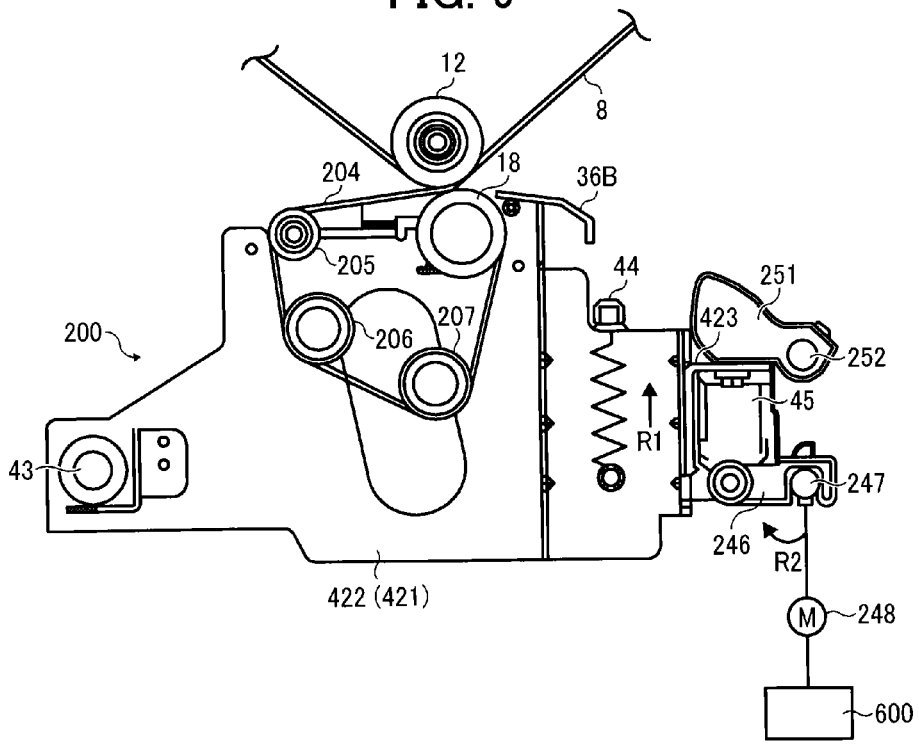
FIG. 9 is a schematic diagram illustrating a secondary transfer device 200.

FIG. 9 is a schematic diagram illustrating the secondary transfer device 200.

The secondary transfer device 200 includes the secondary transfer belt 204, four rollers which have been described above to support the secondary transfer belt 204, a first guide (lower guide) 36B, a pair of first springs 44, a front lateral plate (frame) 421, a rear lateral plate (frame) 422, a stay 423, a shaft (fulcrum) 43, and a second spring 45.

Figure 10:
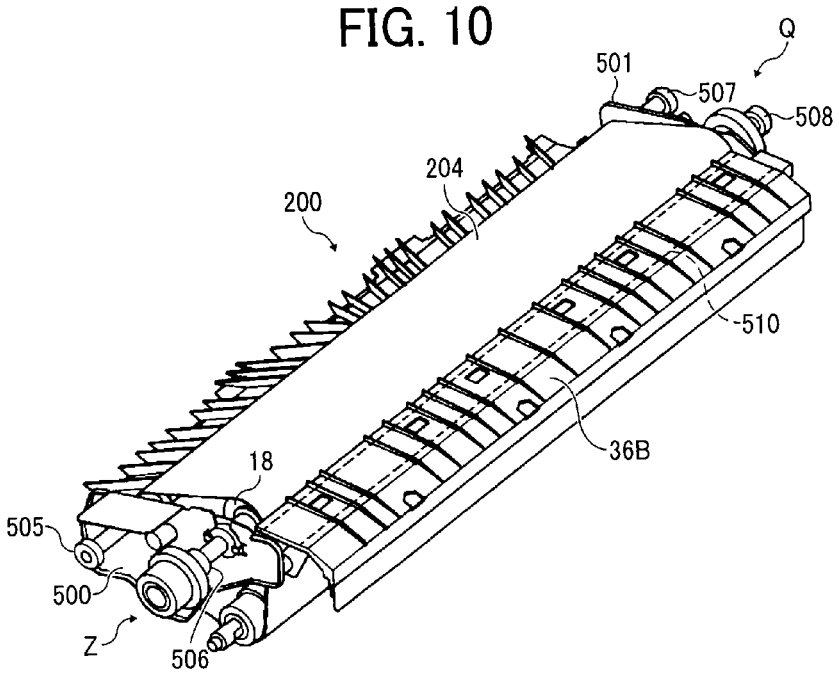
FIG. 10 is a perspective view schematically illustrating a secondary transfer belt 204 and a first guide 36B employed in the secondary transfer device 200.

The front lateral plate 421 supports one end of four rollers 205, 206, 207, and 18 via a sub-frame 500 (illustrated in FIG. 10). These four rollers 205, 206, 207, and 18 support the secondary transfer belt 204. The front lateral plate 421 supports the secondary transfer belt 204 via the sub-frame 500 at the proximal (front) side of the secondary transfer device 200.

The rear lateral plate 422 supports the other end of four rollers 205, 206, 207, and 18 via a sub-frame 501 (illustrated in FIG. 10). These four rollers 205, 206, 207, and 18 support the secondary transfer belt 204. The rear lateral plate 422 supports the secondary transfer belt 204 via the sub-frame 501 at the distal side of the secondary transfer device 200.

The first guide 36B is supported by a stay 510, which will be described later. The front lateral plate 421 supports one end of the stay 510 via the sub-frame 500. The rear lateral plate 422 supports the other end of the stay 510 via the sub-frame 501. The front lateral plate 421 supports the first guide 36B via the sub-frame 500 at the proximal side of the secondary transfer device 200. The rear lateral plate 422 supports the first guide 36B via the sub-frame 501 at the distal side of the secondary transfer device 200.

The stay 423 extends in the front-back direction, with one end thereof fixed to the front lateral plate 421 and the other end thereof fixed to the rear lateral plate 422. The stay 423 connects the front lateral plate 421 and the rear lateral plate 422.

The shaft 43 is fixed to the main body of the image forming apparatus, and rotatably supports the front lateral plate 421 and the rear lateral plate 422. The secondary transfer device 200 includes the pair of first springs 44. The pair of first springs 44 is tension springs. A lower end of one of the first springs 44 is connected to the front lateral plate 421 while the upper end of the first spring 44 is connected to the main body of the image forming apparatus. A lower end of the other one of the first springs 44 is connected to the rear lateral plate 422 while the upper end thereof is connected to the main body of the image forming apparatus.

The pair of first springs 44 biases the front lateral plate 421 and the rear lateral plate 422 in the direction of arrow R1 in FIG. 9 with the shaft 43 in the center. The pair of first springs 44 biases the secondary transfer belt 204 and the first guide 36B in the direction of arrow R1, that is, upward, with the shaft 43 in the center.

A lever 251 and a shaft 252 are disposed substantially above the stay 423. The lever 251 and the shaft 252 constitute a separation device to separate the secondary transfer device 200 from the intermediate transfer belt 8. The lever 251 is fixed to the shaft 252. The shaft 252 is fixed to the main body of the image forming apparatus. A motor is connected to the shaft 252 to rotate the shaft 252. As the shaft 252 is rotated so as to rotate the lever 251 in the counterclockwise direction, the stay 243 is pushed down. Accordingly, the front lateral plate 421 and the rear lateral plate 422 connected to the stay 423 rotate about the shaft 43 in the direction opposite to the direction of arrow R1. The secondary transfer belt 204 and the first guide 36B are pressed down, thereby separating the secondary transfer belt 204 from the intermediate transfer belt 8.

When no image forming operation is performed and/or when clearing paper jams, the above-described separation device pushes down the secondary transfer belt 204 and the first guide 36B. With this configuration, deformation (i.e., depression) of the surface of the intermediate transfer belt 8 and the secondary transfer belt 204 is prevented, and paper jams can be cleared with ease.

A moving device that moves the secondary transfer roller 18 and the first guide 36B further upward is disposed at the right side of the secondary transfer device 200. A second spring 45, a pressing lever 246, a shaft 247, and a motor (driving device) 248 constitute the moving device. A controller 600 such as a central processing unit (CPU) controls the motor 248. The motor 248 is connected to the shaft 247. The shaft 247 is fixed to the main body of the image forming apparatus. One end (right end in FIG. 9) of the pressing lever 246 is fixed to the shaft 247. The other end (left end in FIG. 9) of the pressing lever 246 contacts the lower end of the second spring 45. The second spring 45 is a compression spring, with the lower end thereof contacting the pressing lever 246 and the upper end thereof being supported by the stay 243. The driving force of the motor 248 enables the pressing lever 246 to rotate about the shaft 247 in the direction of arrow R2.

The controller 600 drives the motor 248 in accordance with a basis weight (grams per square meter) or a thickness of the recording medium P to be used. Based on the information on the type of the recording medium P provided by users using the operation panel or a detection result (i.e., the sheet basis weight) provided by a detector that detects the sheet basis weight, the controller 600 obtains the information on the basis weight of the recording medium P to be used. When forming an image on a recording medium P having the sheet basis weight equal to or greater than 350 gsm, the controller 600 drives the motor 248 to enable the pressing lever 246 to rotate in the direction of arrow R2. Accordingly, the second spring 45 is compressed by a predetermined amount, thereby biasing the stay 423 upward. The front lateral plate 421 and the rear lateral plate 422 connected to the stay 423 rotate about the shaft 43 in the direction of arrow R1 by a predetermined amount. The secondary transfer belt 204 and the first guide 36B are pushed up by a predetermined amount.

When forming an image on a recording medium P having the sheet basis weight less than 350 gsm, the controller 600 drives the motor 248 to enable the pressing lever 246 to rotate in the direction opposite to the direction of arrow R2. In this case, the compression amount of the second spring 45 is zero, and the stay 423 is not biased. The secondary transfer belt 204 and the first guide 36B are lowered by a predetermined amount, more than when forming an image on the recording medium P having the sheet basis weight equal to or greater than 350 gsm.

FIG. 10 is a perspective view schematically illustrating the secondary transfer belt 204 and the first guide 36B employed in the secondary transfer device 200. The side indicated by arrow Z coincides the proximal side of the drawing in FIG. 9.

The sub-frame 500 is disposed at the proximal side (i.e., the lower left side in FIG. 10) of the secondary transfer roller 18. Similarly, the sub-frame 501 is disposed at the distal side (i.e., the upper right side in FIG. 10) of the secondary transfer roller 18.

The stay 510 is disposed below the first guide 36B. The stay 510 extends from the proximal side to the distal side. The lower surface of the first guide 36B is fixed to the stay 510. The lower surface of the first guide 36B is a surface opposite to the upper surface thereof that contacts the recording medium P.

Figure 11:
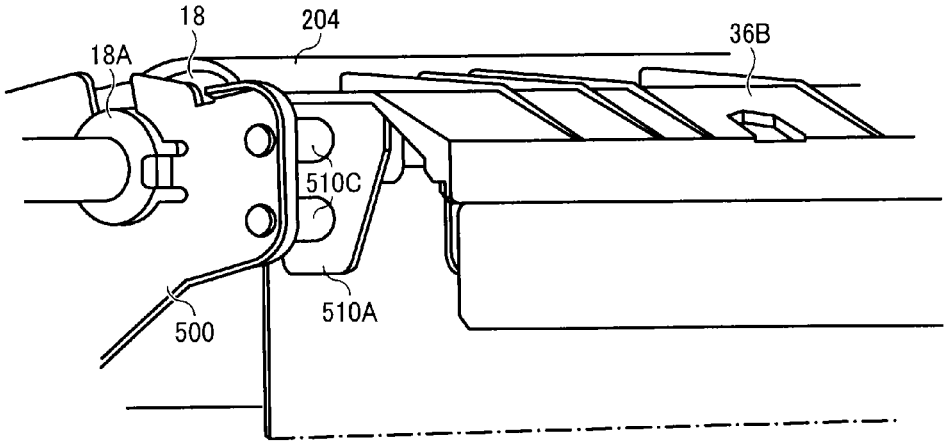
FIG. 11 is an enlarged perspective view schematically illustrating the secondary transfer belt 204 and the first guide 36B as viewed along arrow Z in FIG. 10.

FIG. 11 is an enlarged perspective view schematically illustrating the secondary transfer belt 204 and the first guide 36B as viewed along arrow Z in FIG. 10. The proximal end of the stay 510 (in FIG. 10) is bent, and this portion is referred to as a bent portion 510A (illustrated in FIG. 11). As illustrated in FIG. 11, the bent portion 510A includes two studs 510C. The studs 510C are fixed to the sub-frame 500. The first guide 36B is fixed to the sub-frame 500 via the stay 510 and the studs 510C, and is positioned in place relative to the sub-frame 500.

As illustrated in FIG. 11, the sub-frame 500 includes a notch, and a rolling bearing 18A for the secondary transfer roller 18 is fitted to the notch. The secondary transfer roller 18 is fixed to the sub-frame 500 via the rolling bearing 18A and is positioned in place relative to the sub-frame 500. Similarly, other rollers that support the secondary transfer belt 204 are fixed to the sub-frame 500 via shaft bearings and sheet metals. With this configuration, the proximal end portion of the secondary transfer belt 204 is positioned in place relative to the sub-frame 500.

With this configuration, the proximal end portions of the secondary transfer belt 204 and the first guide 36B at the proximal side of the secondary transfer device 200 are positioned in place relative to the same sub-frame 500.

Figure 12:
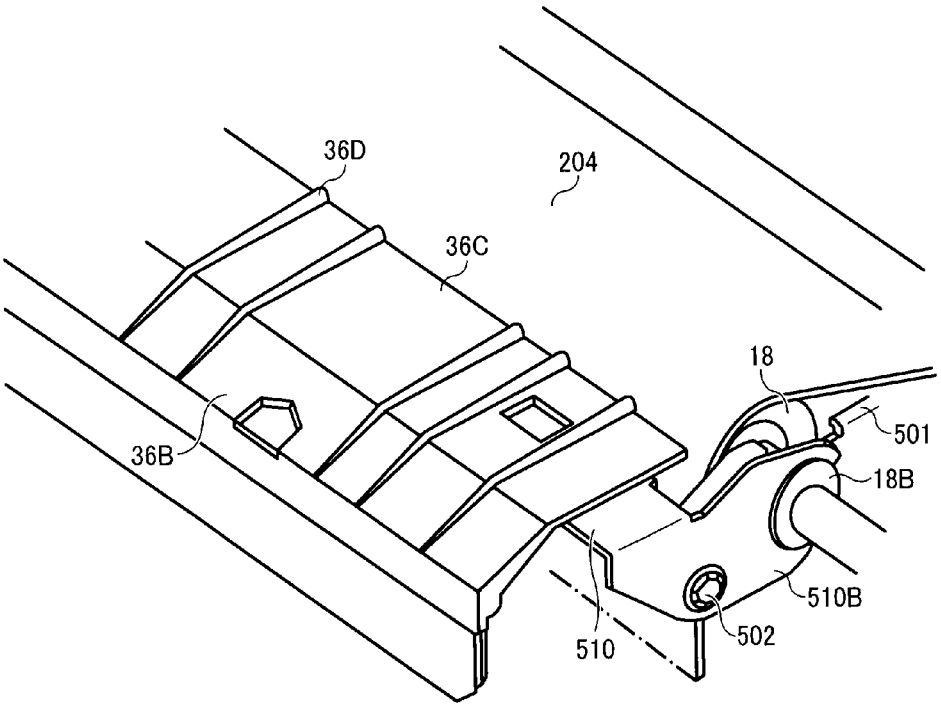
FIG. 12 is an enlarged perspective view schematically illustrating the secondary transfer belt 204 and the first guide 36B as viewed along arrow Q in FIG. 10.

FIG. 12 is an enlarged perspective view schematically illustrating the secondary transfer belt 204 and the first guide 36B as viewed along arrow Q in FIG. 10. The distal end of the stay 510 (in FIG. 10) is bent, and this portion is referred to as a bent portion 510B (illustrated in FIG. 11).

The bent portion 510B includes a notch, and a rolling bearing 18B for the secondary transfer roller 18 is fitted to the notch. The secondary transfer roller 18 is fixed to the bent portion 510B via the rolling bearing 18B and is positioned in place relative to the bent portion 510B. The bent portion 510B is fixed to the sub-frame 501 by a screw 502.

Similarly, other rollers that support the secondary transfer belt 204 are fixed to the sub-frame 501 via shaft bearings and sheet metals. With this configuration, the distal end portion of the secondary transfer belt 204 is positioned in place relative to the sub-frame 501.

With this configuration, the distal end portions of the secondary transfer belt 204 and the first guide 36B at the distal side of the secondary transfer device 200 are positioned in place relative to the same sub-frame 501.

The positioning accuracy of the first guide 36B relative to the secondary transfer belt 204 is enhanced by positioning both ends of the secondary transfer belt 204 and the first guide 36B in place relative to the same parts. Furthermore, the transport (guiding) accuracy of the first guide 36 that guides the recording medium P to the secondary transfer belt 204 is enhanced.

In FIG. 10, a roller 506 is press fit to the proximal end of the secondary transfer roller 18. A roller 505 is press fit to the end portion of the separation roller 205 (shown in FIG. 9). The rollers 505 and 506 are mounted on the upper surface of the front lateral plate 421 shown in FIG. 9 and are positioned in place relative to the front lateral plate 421. Similarly, in FIG. 10, a roller 508 is press fit to the distal end of the secondary transfer roller 18. A roller 507 is press fit to the end portion of the separation roller 205 (shown in FIG. 9). The rollers 507 and 508 are mounted on the upper surface of the rear lateral plate 422 shown in FIG. 9 and are positioned in place relative to the rear lateral plate 422. With this configuration, the secondary transfer belt 204 and the first guide 36B are fixed to the front lateral plate 421 and the rear lateral plate 422 of the secondary transfer device 200, and are positioned in place.

In FIG. 9, the first guide 36B or the secondary transfer belt 204 are pivotally movable about the shaft 43 by pressure from the recording medium P being transported. When receiving downward pressure from the recording medium P, the first guide 36B or the secondary transfer belt 204 can pivotally move in the direction opposite to the direction of arrow R1 against the tension of the first spring 44.

The secondary transfer device 200 includes the first guide 36B, the support including the front lateral plate 421 and the rear lateral plate 422, the stay 510, and the lateral plates, i.e., the sub-frames 500 and 501. The front lateral plate 421 and the rear lateral plate 422 support integrally the first guide 36B and the secondary transfer belt 204. The first guide 36B and the secondary transfer belt 204 are biased by the first spring 44 or the like and are movable integrally in the direction of bias (i.e., vertically up and down direction in FIG. 9).

The first guide 36B and the secondary transfer belt 204 are integrally supported and integrally movable. As will be described later, even when a force of the recording medium P acts on both the first guide 36B and the secondary transfer belt 204, hence (pivotally) moving the first guide 36B and the secondary transfer belt 204, the first guide 36 can still reliably guide the recording medium P to the secondary transfer belt 204.

Figure 13:
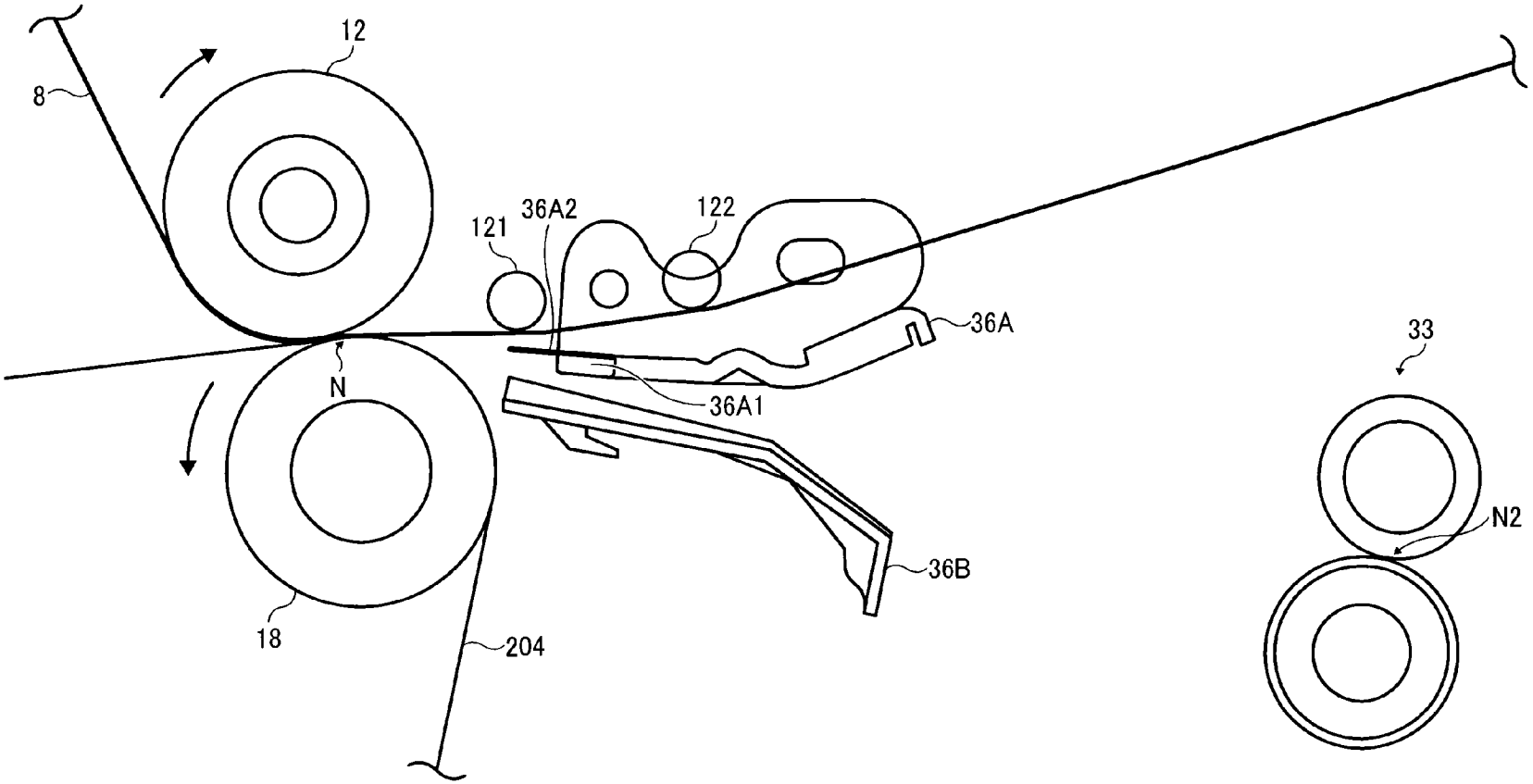
FIG. 13 is a schematic diagram illustrating a secondary transfer nip, a pair of entry guides 36, and the pair of registration rollers as viewed from a proximal side of the image forming apparatus.

FIG. 13 is a schematic diagram illustrating the secondary transfer nip, the pair of entry guides 36, and the pair of registration rollers 33 as viewed from the proximal side of the secondary transfer device 200. The secondary-transfer opposed roller 12 supports the intermediate transfer belt 8 at the secondary transfer nip N. Pressing rollers 121 and 122 support the intermediate transfer belt 8 at a position upstream from the secondary transfer nip N in the direction of travel of the intermediate transfer belt 8. The intermediate transfer belt 8 supported by the pressing rollers 121 and 122 can wind around the surface of the secondary transfer belt 204 by a predetermined amount upstream from an area at which the secondary-transfer opposed roller 12 and the secondary transfer roller 18 contact via the intermediate transfer belt 8.

According to the present illustrative embodiment, the pair of entry guides 36 includes the first guide 36B and an upper guide 36A. The first guide 36B contacts the back surface of the recording medium P, and the upper guide 36A contacts the front surface of the recording medium P. The upper guide 36A includes a second guide 36A1 and a third guide 36A2 As will be later described in detail, the second guide 36A1 prevents the recording medium P from bending toward the intermediate transfer belt 8. The frames of an intermediate transfer unit (transfer unit 7) positioned in place relative to the main body support the intermediate transfer belt 8, the secondary-transfer opposed roller 12, and the pressing rollers 121 and 122. The upper guide 36A is fixed to the frame of the intermediate transfer unit (transfer unit 7).

The third guide 36A2 prevents the trailing edge of the recording medium P from striking hard the surface of the intermediate transfer belt 8 after the trailing edge of the recording medium P separates from the second guide 36A1. The pair of entry guides 36 regulates the position of the recording medium P during transportation by contacting the back surface and the front surface of the recording medium P, thereby transporting reliably the recording medium P.

As illustrated in FIG. 12, a base 36C and a plurality of ribs 36D are formed on the upper surface of the first guide 36B. The plurality of ribs 36D extends in the transport direction of the recording medium P and projects from the base 36C. The direction of projection of the plurality of ribs 36D is perpendicular to the transport direction and the width direction of the recording medium P. In other words, the direction of projection coincides with the thickness of the recording medium P. An imaginary plane that runs through a ridgeline of the plurality of ribs 36D is referred to as a guide surface. In FIG. 13, the upper surface of the first guide 36B corresponds to the guide surface.

The plurality of ribs 36D prevents contaminants (for example, toner spattered from the secondary transfer belt 204) accumulated on the base 36C from sticking to the back surface of the recording medium P.

As illustrated in FIG. 12, the height of each of the plurality of ribs 36D from the base 36C increases toward the downstream side in the transport direction of the recording medium P. As described above, preferably, the height of each of the plurality of ribs 36D increases toward the downstream side in the transport direction of the recording medium P, that is, toward the secondary transfer belt 204. With this configuration, the distance from an area near the secondary transfer belt 204 at which a large amount of contaminants accumulates to the guide surface can be long, thereby preventing reliably contamination of the back surface of the recording medium P near the secondary transfer belt 204.

Figure 14A:
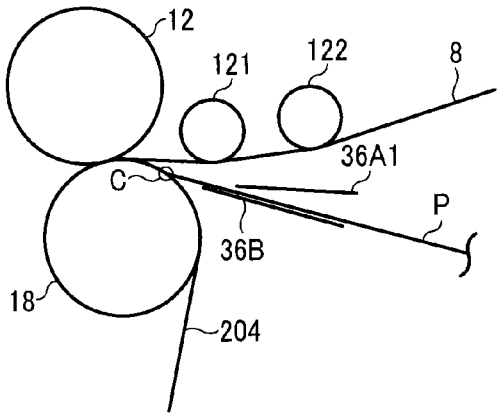
FIGS. 14A through 14C are schematic diagrams partially illustrating a configuration shown in FIG. 13 and a position of the recording medium P while being transported.
Figure 14B:
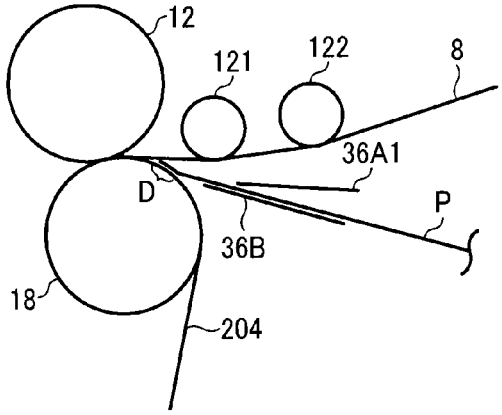
Figure 14C:
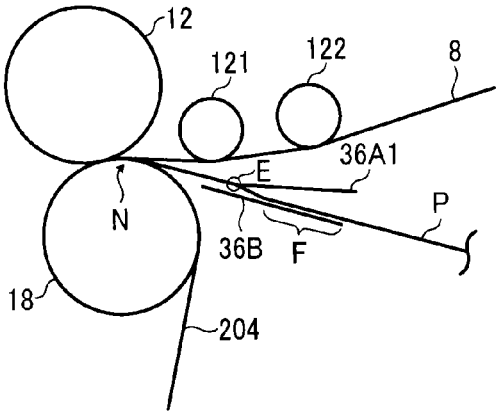

FIGS. 14A through 14C are schematic diagrams partially illustrating the configuration shown in FIG. 13 and the position of the recording medium P during transportation. FIG. 14A illustrates a state in which the leading end of the recording medium P contacts the surface of the secondary transfer belt 204. FIG. 14B illustrates a state in which the leading end of the recording medium P immediately before entering the secondary transfer nip N. FIG. 14C illustrates a state in which the leading end of the recording medium P after entering the secondary transfer nip N. FIGS. 14A through 14C illustrate the position of the recording medium P during transportation in a case in which the sheet basis weight is less than a predetermined value.

In FIG. 14A, the leading end of the recording medium P contacts the surface of the secondary transfer belt 204 at an intersection C of the extension line of the guide surface of the upper surface of the first guide 36B and the surface of the secondary transfer belt 204. The intersection C is situated below the secondary transfer nip N. It is to be noted that in FIG. 13 near the pair of registration rollers 33 the recording medium P fed from the pair of registration rollers 33 is transported toward the extension line of the nip N2 formed by the pair of registration rollers 33. However, near the first guide 36B, the recording medium P is transported slightly below the extension line of the nip N2 of the pair of registration rollers 33 due to its own weight. Accordingly, the recording medium P contacts the guide surface of the first guide 36B (lower guide).

In FIG. 14B, the leading end of the recording medium P is guided along the surface of the secondary transfer belt 204 from the intersection C illustrated in FIG. 14A and enters the secondary transfer nip N. At this time, the recording medium P is curved up in a region D downstream from the intersection C in the transport direction of the recording medium P as compared with other regions (on the right side in FIG. 14B). Since the recording medium P has some resilience, a restoration force of the recording medium P acts on the region D.

This force is a downward force that pushes the surface of the secondary transfer belt 204 down. With this force, the secondary transfer belt 204 pivotally moves down against the tension of the first spring 44. With this configuration, before the recording medium P enters the secondary transfer nip N, the secondary transfer belt 204 can pivotally move in a direction in which the secondary transfer belt 204 separates from the intermediate transfer belt 8, thereby absorbing an impact when the recording medium P enters the secondary transfer nip N. The impact generated when the recording medium P contacts the intermediate transfer belt 8 is reduced. As described above, the shock jitter is minimized with the simple configuration when the recording medium P enters the secondary transfer nip N.

As described above, the image forming apparatus includes the pair of entry guides 36 that guides the recording medium P at a position upstream from the secondary transfer belt 204 in the transport direction of the recording medium P. The pair of entry guides 36 includes the first guide 36B. In FIGS. 14A and 14B the secondary transfer belt 204 is biased upward by the first spring 44 serving as a biasing member, and is movable up and down.

The first guide 36B of the pair of entry guides 36 guides the recording medium P at a position lower than the secondary transfer nip N such that the leading end of the recording medium P contacts the secondary transfer belt 204 before the leading end of the recording medium P enters the secondary transfer nip N. With this configuration, before the recording medium P enters the secondary transfer nip N, the secondary transfer belt 204 can pivotally move in a direction in which the secondary transfer belt 204 separates from the intermediate transfer belt 8, thereby absorbing an impact when the recording medium P enters the secondary transfer nip N.

In FIGS. 9 and 13, the direction of pivotal movement of the secondary transfer belt 204 is vertical (up-and-down direction), and the direction of bias of the first spring 44 against the secondary transfer belt 204 is upward. However, the direction of pivotal movement and the direction of bias do not necessarily coincide completely with a vertical direction (i.e., direction of gravity). For example, in some embodiments, the direction of pivotal movement can be inclined at 30 degrees in the vertical direction. In this case, the secondary transfer belt 204 is pushed down in the direction of pivotal movement due to the downward restoration force of the recording medium P until the recording medium P that comes in contact with the secondary transfer belt 204 at a position lower than the secondary transfer nip N is transported to the secondary transfer nip N.

As described above, the pair of entry guides 36 includes the first guide 36B with the guide surface that contacts the back surface of the recording medium P. The intersection C of the extension line of the guide surface and the secondary transfer belt 204 is lower than the secondary transfer nip N. With this configuration, the leading end of the recording medium P can be transported to the intersection C accurately, and the shock jitter is minimized reliably when the recording medium P enters the secondary transfer nip N.

It is to be noted that according to the present illustrative embodiment the guide surface (the imaginary plane that runs through the ridgeline of the plurality of ribs 36D) is substantially flat. Alternatively, in some embodiments, the guide surface may be a curved surface. In this case, the intersection C of an extension line of a tangent line to the curved surface at the end portion of the guide surface in the transport direction of the recording medium P and the secondary transfer belt 204 is situated lower than the secondary transfer nip N.

In FIG. 14C, the leading end of the recording medium P has already entered the secondary transfer nip N. At this time, the recording medium P is interposed between the intermediate transfer belt 8 and the secondary transfer belt 204 and is transported by both belts.

In the region upstream from the start of the secondary transfer nip N, the transport position of the recording medium P interposed between the intermediate transfer belt 8 and the secondary transfer belt 204 shifts upward. The second guide 36A1 prevents the recording medium P from moving up (to the intermediate transfer belt 8). Accordingly, the recording medium P contacts the second guide 36A1 at a leading edge position E of the second guide 36A1. The back surface of the recording medium P bends toward the guide surface due to its own weight at a position upstream from the leading edge position E in the transport direction of the recording medium P (i.e., at the right side in FIG. 14C).

The first guide 36B and the second guide 36A1 are disposed in proximity to each other such that the back surface of the recording medium P bends toward the guide surface and contacts the guide surface at a position upstream from the leading edge position E in the transport direction of the recording medium P. The front surface of the recording medium P contacts a region F in FIG. 14C. Flexure of the recording medium P produces a pressing force to press the first guide 36B down. As described above, since the first guide 36B is movable together with the secondary transfer belt 204, the first guide 36B and the secondary transfer belt 204 pivotally move down against the force of the first spring 44. With this configuration, in a state in which the recording medium P has entered the secondary transfer nip N, an impact when the trailing edge of the recording medium P advances further to the secondary transfer nip N is absorbed. That is, the impact when the trailing edge of the recording medium P contacts the intermediate transfer belt 8 is reduced. As described above, the shock jitter can be reduced with the simple configuration, if not prevented entirely, while the recording medium P is being transported in the secondary transfer nip N.

In order to reliably bend the recording medium toward the guide surface in the region F, preferably, the linear velocity of the pair of registration rollers 33 (i.e., a traveling speed of the surface) is faster than the linear velocity (i.e., a traveling speed of the surface of the belt) of the secondary transfer belt 204 and the intermediate transfer belt 8. Accordingly, the shock jitter is reduced with the simple configuration, if not prevented entirely, while the recording medium P is being transported in the secondary transfer nip N.

Figure 15:
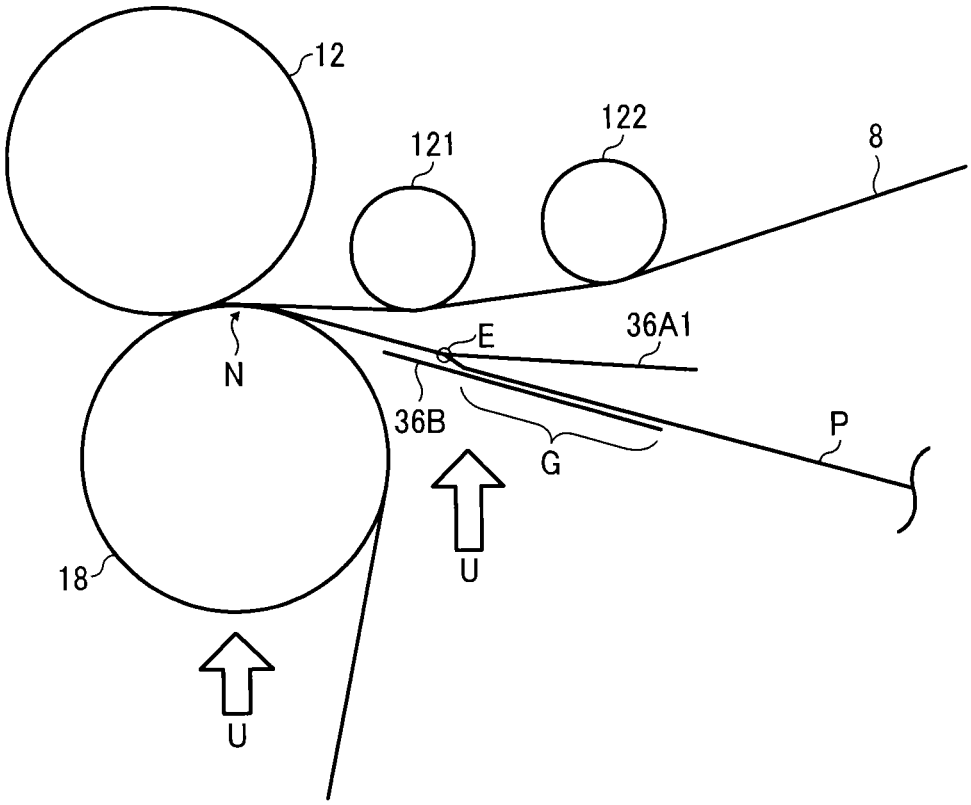
FIG. 15 is a schematic diagram partially illustrating the configuration shown in FIG. 13 and the orientation of the recording medium P having a basis weight (grams per square meter) equal to or greater than a predetermined amount while being transported.

FIG. 15 is a schematic diagram partially illustrating the configuration shown in FIG. 13 and the position of the recording medium P having a basis weight (grams per square meter) equal to or greater than a predetermined amount while being transported.

As described above, the image forming apparatus includes the moving device that moves the first guide 36B toward the second guide 36A1, and the controller 600 to control the moving device. The second spring 45, the pressing lever 246, the shaft 247, and the motor (driving device) 248 constitute the moving device. In a case in which the sheet basis weight of the recording medium P is equal to or greater than a predetermined value (i.e., 320 gsm in the present illustrative embodiment), the controller 600 controls the moving device to move the first guide 36B toward the second guide 36A1 more than when the thickness of the recording medium P is less than a predetermined value (i.e., 320 gsm in the present illustrative embodiment). When the sheet basis weight is equal to or greater than the predetermined value, the first guide 36B and the secondary transfer belt 204 are pushed up in the direction indicated by an arrow U.

Generally, the thickness of a recording medium P having the sheet basis weight equal to or greater than the predetermined value is relatively thick, and the stiffness thereof is relatively high. Consequently, when such a recording medium P enters the secondary transfer nip N one after the other, the shock jitter occurs more pronouncedly. According to the present illustrative embodiment, in a case in which the sheet basis weight of the recording medium P is equal to or greater than a predetermined value, the first guide 36B is moved toward the second guide 36A1. In this case, the back surface of the recording medium P contacts the guide surface in a region G in FIG. 15.

When the first guide 36B and the second guide 36A1 are situated closer, the recording medium P is interposed more tightly in a region upstream from the leading edge position E. In other words, the recording medium P is pressed in the thickness direction. As a result, the width of the region G is greater than the region F illustrated in FIG. 14C. Furthermore, the pressure of the recording medium P pressing against the guide surface increases. With this configuration, an impact when the trailing edge of the recording medium P with a large basis weight advances further to the secondary transfer nip N is absorbed even more. When using the recording medium P with a large sheet basis weight which causes the shock jitter more pronouncedly, the impact when the trailing edge of the recording medium P contacts the intermediate transfer belt 8 is reduced more.

According to the present illustrative embodiment, the secondary transfer device 200, the separation device, and the moving device are mounted in the main body of the image forming apparatus. Alternatively, in some embodiments, the secondary transfer device 200, the separation device, and the moving device are constituted as a single integrated unit detachably attachable relative to the main body. In this case, preferably, the shafts 43 and 252 are fixed to frames of the unit. According to the present illustrative embodiment, the recording medium includes, but is not limited to, a transfer paper, a plastic sheet, and a fabric sheet. The present disclosure can be applied to an image forming apparatus that transfers images on to a plastic sheet and a fabric sheet.

According to the illustrative embodiments of the present disclosure, the guide position of the guide is lower than the transfer nip. During the time after the leading end of the recording medium contacts the secondary transfer member until the leading end of the recording medium arrives at the secondary transfer nip and is in the secondary transfer nip, the restoration force of the recording medium acts on the secondary transfer member so that the secondary transfer member moves in the direction of bias or vertically downward. This configuration reduces the impact when the recording medium comes in contact with the intermediate transfer belt and is in the secondary transfer nip, and hence the shock jitter is reduced with a simple structure while maintaining the productivity.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer on which a toner image is formed;

an intermediate transfer belt onto which the toner image is transferred from the image bearer;

a secondary transfer member disposed opposite to the intermediate transfer belt, a secondary transfer nip being formed between the secondary transfer member and the intermediate transfer belt;

a guide assembly disposed upstream from the secondary transfer member in a transport direction of a recording sheet, to guide the recording sheet at a position lower than the secondary transfer nip such that a leading end of the recording sheet contacts the secondary transfer member before entering the secondary transfer nip; and a biasing device to bias the secondary transfer member to move the secondary transfer member in at least one of a direction of bias and a vertical direction, wherein:

the guide assembly includes a first guide with a guide surface that contacts a back surface of the recording sheet, and an intersection of an extension line of the guide surface and the secondary transfer member is substantially lower than the secondary transfer nip, the image forming apparatus further comprises a support that supports integrally the first guide and the secondary transfer device, the biasing device is connected to the support, and the first guide and the secondary transfer member are integrally movable in at least one of the direction of bias and the vertical direction by a biasing force of the biasing device.

2. The image forming apparatus according to claim 1, wherein the first guide includes a plurality of ribs that extends in the transport direction of the recording sheet.

3. The image forming apparatus according to claim 2, wherein a height of the plurality of ribs increases toward a downstream side in the transport direction of the recording sheet.

4. The image forming apparatus according to claim 1, wherein the guide assembly includes a second guide that contacts a front surface of the recording sheet, and in a state in which the recording sheet has entered the secondary transfer nip the back surface of the recording sheet bends toward the guide surface of the first guide and contacts the guide surface at a position upstream from the second guide in the transport direction of the recording sheet.

5. The image forming apparatus according to claim 4, further comprising:

a moving device to move the first guide toward the second guide; and a controller operatively connected to the moving device to control the moving device, wherein in a case in which a basis weight of the recording sheet is equal to or greater than a predetermined value, the controller controls the moving device to move the first guide toward the second guide by an amount greater than in a case in which the basis weight of the recording sheet is less than a predetermined value.

6. The image forming apparatus according to claim 1, further comprising a pair of feed rollers disposed upstream from the guide assembly in the transport direction of the recording sheet to feed the recording sheet, wherein a nip formed by the pair of feed rollers is situated lower than the guide assembly.

7. The image forming apparatus according to claim 6, wherein the guide assembly includes a second guide that contacts a front surface of the recording sheet, and a leading end of the second guide projects beyond a line segment from a start of the secondary transfer nip to the nip of the pair of feed rollers toward the secondary transfer member.

8. The image forming apparatus according to claim 1, wherein the guide assembly includes a first guide that contacts a back surface of the recording sheet and a second guide that contacts a front surface of the recording sheet.

9. The image forming apparatus according to claim 1, wherein the secondary transfer member comprises a secondary transfer belt.

10. The image forming apparatus according to claim 1, further comprising a secondary-transfer opposed roller disposed inside a loop formed by the intermediate transfer belt and opposite to the secondary transfer member, wherein the secondary transfer member is disposed offset to the upstream side in the transport direction of the recording sheet relative to the secondary-transfer opposed roller.

11. The image forming apparatus according to claim 1, wherein:

the support includes a frame, the biasing device includes a spring, and the frame is urged to rotate around a shaft by the spring.

12. The image forming apparatus according to claim 11, wherein:

the support includes a stay to support the first guide, and the stay has an end positioned relative to the frame.

13. The image forming apparatus according to claim 12, wherein:

the secondary transfer member comprises a secondary transfer belt supported by a plurality of rollers, the plurality of rollers includes a secondary transfer roller disposed opposite to the intermediate transfer belt via the secondary transfer belt, and the end of the stay is positioned relative to the frame via a bearing on the secondary transfer roller.

14. The image forming apparatus according to claim 11, wherein:

the secondary transfer member comprises a secondary transfer belt, and a fulcrum is disposed outside a loop formed by the intermediate transfer belt.

15. The image forming apparatus according to claim 9, wherein:

the secondary transfer belt is supported by a plurality of rollers, the plurality of rollers includes a secondary transfer roller disposed opposite to the intermediate transfer belt via the secondary transfer belt, and the leading end of the recording sheet contacts a surface of the secondary transfer belt at a wound portion of the secondary transfer belt wound around the secondary transfer roller.

* * * * *